US005820471A

United States Patent [19]

Briggs

[11] Patent Number: 5,820,471

[45] Date of Patent: Oct. 13, 1998

[54] PARTICIPATORY WATER PLAY SYSTEM

[76] Inventor: Rick A. Briggs, 64 Maple Grove Rd., Springfield, Ill. 62707

[21] Appl. No.: 409,133

[22] Filed: Mar. 23, 1995

Related U.S. Application Data

[63] Continuation-in-part of Ser. No. 333,373, Dec. 6, 1994, abandoned, which is a continuation of Ser. No. 25,143, Mar. 2, 1993, Pat. No. 5,405,294, which is a continuation of Ser. No. 604,946, Oct. 29, 1990, Pat. No. 5,194,048, Continuation-in-part of Ser. No. 438,220, Nov. 20, 1989, Pat. No. Des. 330,579.

[51] Int. Cl.[6] ..... A63G 31/00

[52] U.S. Cl. ..... 472/128; 472/117; 482/35

[58] Field of Search ..... 472/117, 128; 482/35–37

[56] References Cited

U.S. PATENT DOCUMENTS

| | | |
|---|---|---|
| D. 241,664 | 9/1976 | Ewers et al. . |
| D. 250,783 | 1/1979 | Dieter et al. . |
| D. 250,784 | 1/1979 | Dieter et al. . |
| D. 330,579 | 10/1992 | Briggs . |
| D. 357,299 | 4/1995 | Laing et al. . |
| 1,648,196 | 11/1927 | Rohmer . |
| 3,539,181 | 11/1970 | Larsen et al. . |
| 3,752,472 | 8/1973 | Snead . |
| 4,057,244 | 11/1977 | Gaspar et al. . |
| 4,145,042 | 3/1979 | Becker et al. . |
| 4,149,710 | 4/1979 | Rouchard et al. . |
| 4,573,679 | 3/1986 | Janszen . |
| 4,799,665 | 1/1989 | Bracy et al. . |
| 5,194,048 | 3/1993 | Briggs . |
| 5,385,472 | 1/1995 | Mullin . |
| 5,401,214 | 3/1995 | Smollar et al. . |
| 5,405,294 | 4/1995 | Briggs . |
| 5,480,336 | 1/1996 | Blanchard . |

FOREIGN PATENT DOCUMENTS

| | | |
|---|---|---|
| 1031693 | 6/1958 | Germany . |
| 39 10679 A1 | 3/1989 | Germany . |
| 3812435 | 9/1989 | Germany . |

OTHER PUBLICATIONS

SCS Comopany brohcures of models 107, 108, 109, 110, 112, 115, 212, 245, 333, and 400.

Picture of Mexico Forge, 3800 Series Model 3813–311.

Picture of Sandman Playground Equipment/ The Christina.

Pictures of Braunfelsbilt Products.

Pamphlet for SCS Interactive Family Adventures.

*Primary Examiner*—Carl D. Friedman

*Assistant Examiner*—Beth Aubrey

*Attorney, Agent, or Firm*—Knobbe, Martens, Olson & Bear, LLP

[57] ABSTRACT

A participatory water play system is provided incorporating a plurality of water play elements for creating various desired water effects. The participatory water play system comprises a plurality of multiple-order water effects. A first participatory water play element may be manipulated to create a first-order water effect. A second participatory water play element receives water from the first water effect to create a second-order water effect. Thus, play participants can observe and experiment with various cause-and-effect reactions involving multiple-order water effects.

48 Claims, 18 Drawing Sheets

Fig. 17a
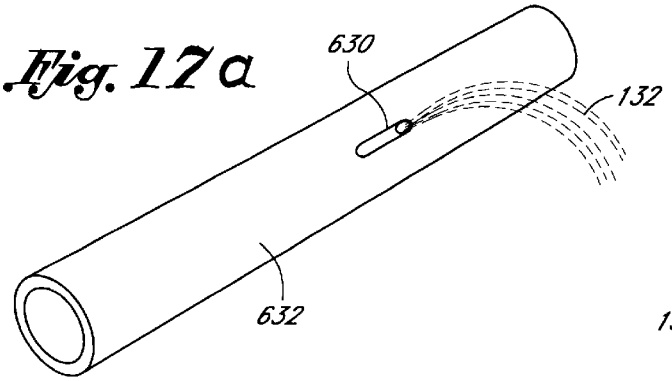
Fig. 17b
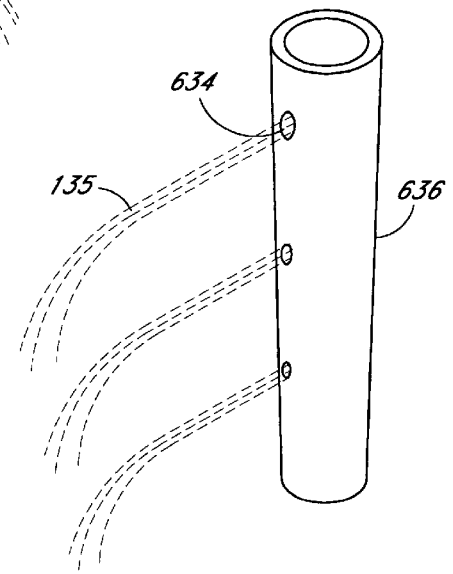
Fig. 17c
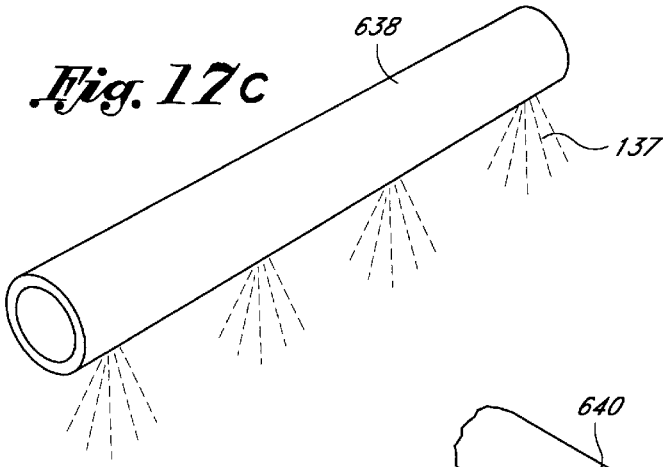
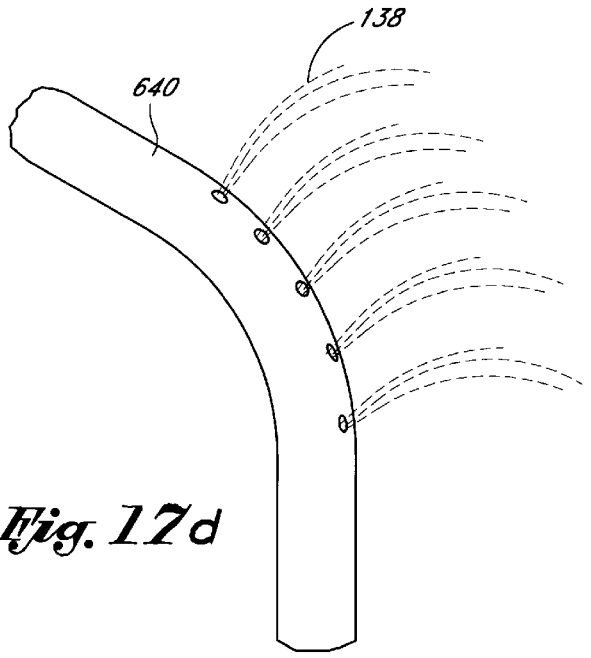
Fig. 17d

PARTICIPATORY WATER PLAY SYSTEM

RELATED APPLICATIONS

This application is a continuation-in-part of co-pending application U.S. Ser. No. 333,373, filed Dec. 16, 1994, which is a continuation of U.S. Ser. No. 025,143, filed Mar. 2, 1993, now U.S. Pat. No. 5,405,294, which is a continuation of U.S. Ser. No. 604,946, filed Oct. 29, 1990, now U.S. Pat. No. 5,194,048, which is a continuation-in-part of U.S. Ser. No. 438,220, filed Nov. 20, 1989, now U.S. Pat. No. D330,579.

BACKGROUND OF THE INVENTION

1. Field of the Invention

The present invention relates to water play structures, and, in particular, to a participatory water play system for entertaining and educating small and intermediate-age children.

2. Description of the Related Art

The popularity of family-oriented water theme parks and recreational water facilities has increased dramatically in the last decade. Water parks have proliferated as adults and children, alike, seek the thrill and entertainment of water parks as a healthy and enjoyable way to cool off in the hot summer months.

Most water theme parks, like their dry counterparts, consist primarily of ride attractions. The most popular among these are water slides in which participants slide down a wet trough or tunnel and splash down into a pool of water. As demand for such water attractions has increased, water parks have continued to evolve ever larger and more complex water slides to thrill and entertain growing numbers of water play participants. Other popular ride attractions include surfing wave simulators, log flumes and white-water rafting.

While these water ride attractions are very popular, particularly among older children and adults, a common complaint is that participants often must spend more time waiting in lines for the various rides than actually riding on them. Also, many of the most popular water rides are unsuited for small children because of the inherent dangers of drowning or possible uncontrolled collision with other ride participants.

As a result, families with small children often have to split their time between either participating in the more popular rides or looking after the small children. While most water parks have recreational facilities for entertaining small children, they are generally limited to small wading pools, miniature water slides, and static play structures. While these may be moderately entertaining for small children, they fail to entertain parents or provide the creative stimulation and interactive educational experience that captivates the imaginations of small and intermediate-age children.

SUMMARY OF THE INVENTION

Accordingly, it is an object of the present invention to provide a participatory water play system that allows children of nearly all ages to play together and to combine their creative inspiration and imaginations to achieve various desired water effects. It is a further object of the present invention to provide a play structure that is entertaining for adults as well as children. It is a further object of the present invention to provide a single play structure in which the entire family can participate and interact with one another without having to wait in long lines.

In accordance with one embodiment of the present invention, a participatory water play system is provided for entertaining one or more play participants. The water play system comprises a support frame and a conduit associated with the support frame for supplying water to various water play elements mounted in, on or adjacent to the support frame. A first participatory water play element is provided comprising a water forming device and a corresponding control valve or actuator for allowing play participants to selectively control the water forming device to create a first water effect. A second participatory water play element receives water from the first water effect to create a second water effect. By controlling the various participatory water play elements, play participants can observe and experiment with various cause-and-effect reactions involving multiple-order water effects.

In accordance with another embodiment, an exciting new water effect is provided comprising a giant bucket or container for collecting water discharged from a water forming device. The container is balanced and conditionally stable so that it periodically spills over when the water level in the container reaches a predetermined level. This creates dramatic visual and sound effects for surprising, entertaining and amusing play participants.

In accordance with yet another embodiment, a multiple-order water effect is provided for allowing play participants to observe and experiment with various cause-and-effect reactions involving water. The water effect comprises a first participatory water play element having an incoming flow of water controlled by one or more play participants to create a first water effect. A second participatory water play element is provided for receiving water from the first water effect to create yet a second water effect. By controlling the first and second water play elements, play participants can observe and experiment with various multiple-order cause-and-effects reactions involving water.

These and other objects and advantages of the present invention will become readily apparent to those skilled in the art from the following detailed description of the preferred embodiments having reference to the attached figures.

DESCRIPTION OF THE DRAWINGS

FIGS. 17*a–g* are perspective views of various water forming elements and associated water effects, including: (a) an arch jet, (b) horizontal jets, (c) rain jets, (d) peacock jets, (e) geyser jets, (f) bar jets, and (g) an attack hose;

DETAILED DESCRIPTION OF THE PREFERRED EMBODIMENTS

My U.S. Pat. No. 5,194,048, hereby incorporated by reference, first disclosed the concept of participatory water play, in which play participants can operate any one of a number of valves to adjust the amount of water spraying from one or more associated nozzles. Play participants adjust the various valves and can immediately observe the change in the rate of water flowing from the various associated nozzles. This allows children to experiment with and learn about first order cause-and-effect reactions using a familiar and entertaining medium, namely water.

The present invention improves and expands upon this theme of participatory water play by introducing second, third and even higher order water effects which may be created or activated by a particular combination of other water effects. Some water effects may have immediate results. Others may have delayed results. Some water effects may be local, while others may be remote. Each play participant, or sometimes a group of play participants working together, must experiment with the various water effects in order to discover which ones operated in which sequence will create the desired water effect. Once one group figures it out, they can use the resulting water effect to surprise and entertain other water play participants. Yet other play participants will observe the water effect and will attempt to also figure it out in order to turn the tables on the next group. The result is an endlessly entertaining and educational experience for the whole family.

Figure 1:
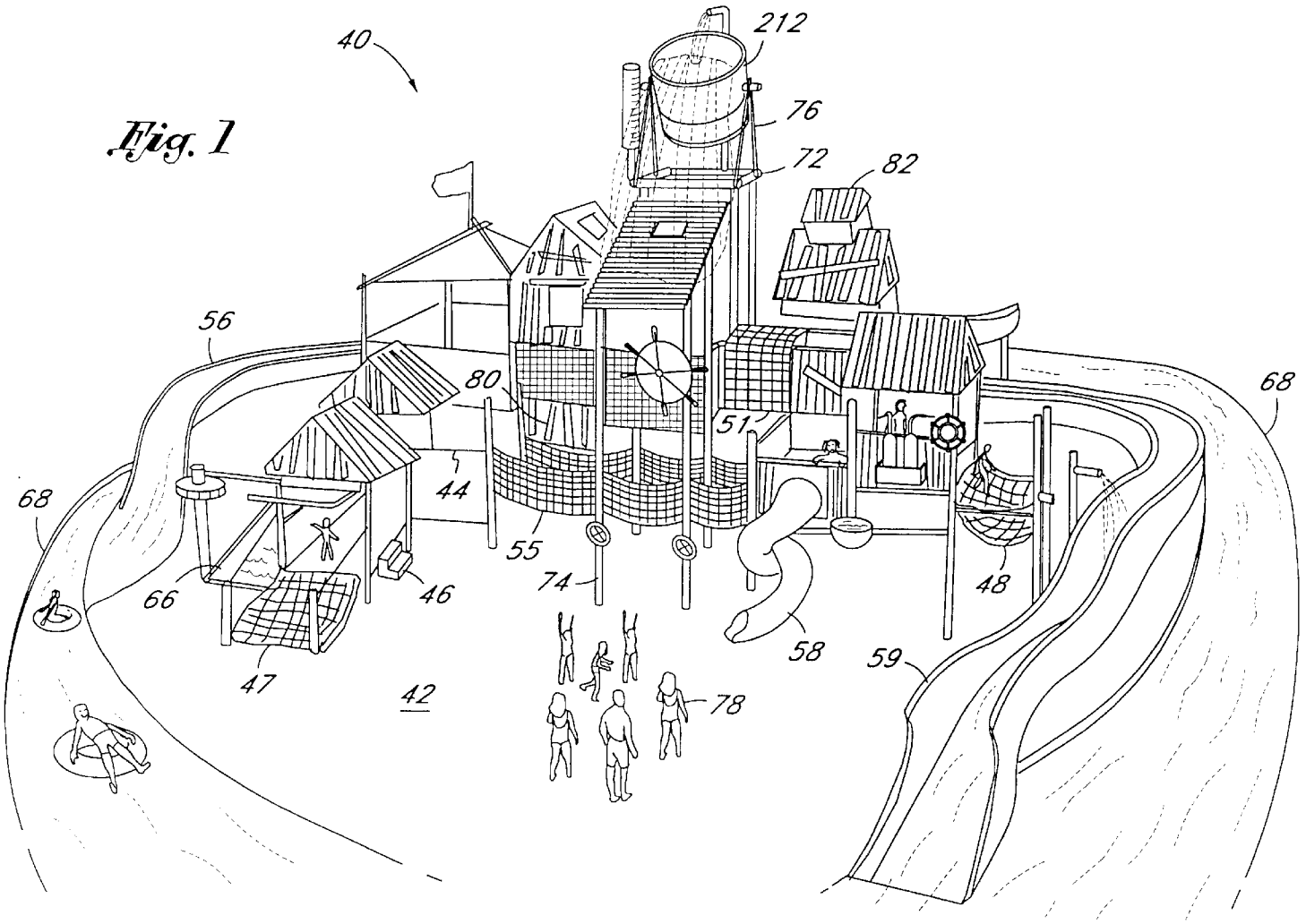
FIG. 1 is a front perspective view of a preferred embodiment of a participatory water play system having features of the present invention.

FIG. 1 illustrates one embodiment of a participatory water play system having features of the present invention. This particular water play system is provided in the form of an island wilderness tree house, as shown. Of course, those skilled in the art will readily appreciate that the participatory water play system of the present invention is not limited to this one preferred embodiment, but may be implemented in accordance with a wide variety of other possible exciting play themes. For example, a pirate's ship, submarine, medieval castle, lost temple, or a fire station can each provide exciting play themes for participatory water play systems having benefits and advantages as taught by the present invention.

Fundamentally, the play system comprises an integrated play structure 40 having multiple levels and/or platforms 42, 44 between which play participants can traverse using stairs 46, ladders or climbing nets 47, 48, crawl tunnels 49–54, and swinging bridges 55. Slides 56, 58–64 originating from the higher levels 44 of the play system 40 can quickly bring the participants down to the ground level 42, or can deposit the participants into an adjacent pool 66 or an optional river loop 68 which surrounds the interactive play system.

The play structure 40 incorporates a variety of participatory water play elements and non-water play elements spaced every few feet. Support for the water play structure 40 is provided by a supporting framework 72 comprising primarily water carrying conduits 74 and non-water carrying framing elements 76. Conduits 74 are preferably selected to be of sufficient size and strength to safely support the play structure 40 and play participants 78 while also supplying water to the various interconnected water play elements.

Preferably, the conduits 74 are formed from hollow steel pipes that are adapted to be bolted or welded together using commercially available pipe fittings. Standard Schedule 40 galvanized steel pipe having an outside diameter of between about 4 and 8 inches and a wall thickness of between about ⅛ and ½ inches should be suitable for most applications. Alternatively, some or all of the conduits 74 may be formed from other suitable materials such as PVC pipe, copper pipe or clay/ceramic pipe, as desired.

Framing elements 76 are selected to safely support non-water play elements and/or to provided additional support for roofing and other optional structures, as desired. Framing elements 76 may be constructed of any convenient material having adequate strength, durability and resistance to corrosion. Aluminum or wood framing elements, galvanized structural steel, PVC pipe or any other corrosion-resistant material may be used, as desired, to provide additional support for the play structure 40 and play participants 78.

It will be apparent to those skilled in the art that a variety of other possible framing designs may be used for constructing the supporting framework 72. For instance, supporting framework 72 may be constructed substantially entirely of non-water carrying framing elements 76. In that event, water may be provided to the various water effects by separate plumbing conduits (not shown) that are either external or internal to the framing elements 76. It is preferred, however, that water carrying conduits 74 be used for forming substantial portions of the supporting framework 72 in order to reduce material costs and to provide fast and easy construction.

For visual appeal and added safety, optional decorative panels and/or roofing elements may be provided, as desired, to complement the particular desired theme of the interactive play system, to shade play participants from the sun or to prevent play participants from falling off the play structure 40. For instance, in the preferred embodiment shown, wooden railings 80 and wood-planked roofs 82 are provided for added safety and to complement the theme of an island wilderness tree house. These optional panels 80, 82 may be made from wood, fiberglass, reinforced fabric, PVC, or other corrosion-resistant materials, as desired. In the particular embodiments shown, pressure treated wood is used because of its high durability, low cost, and pleasing outward appearance. Those skilled in the art will readily appreciate that a wide variety of other decorative or thematic elements may be incorporated into the overall design in order to provide added safety or convey a particular desired play theme.

Figure 2:
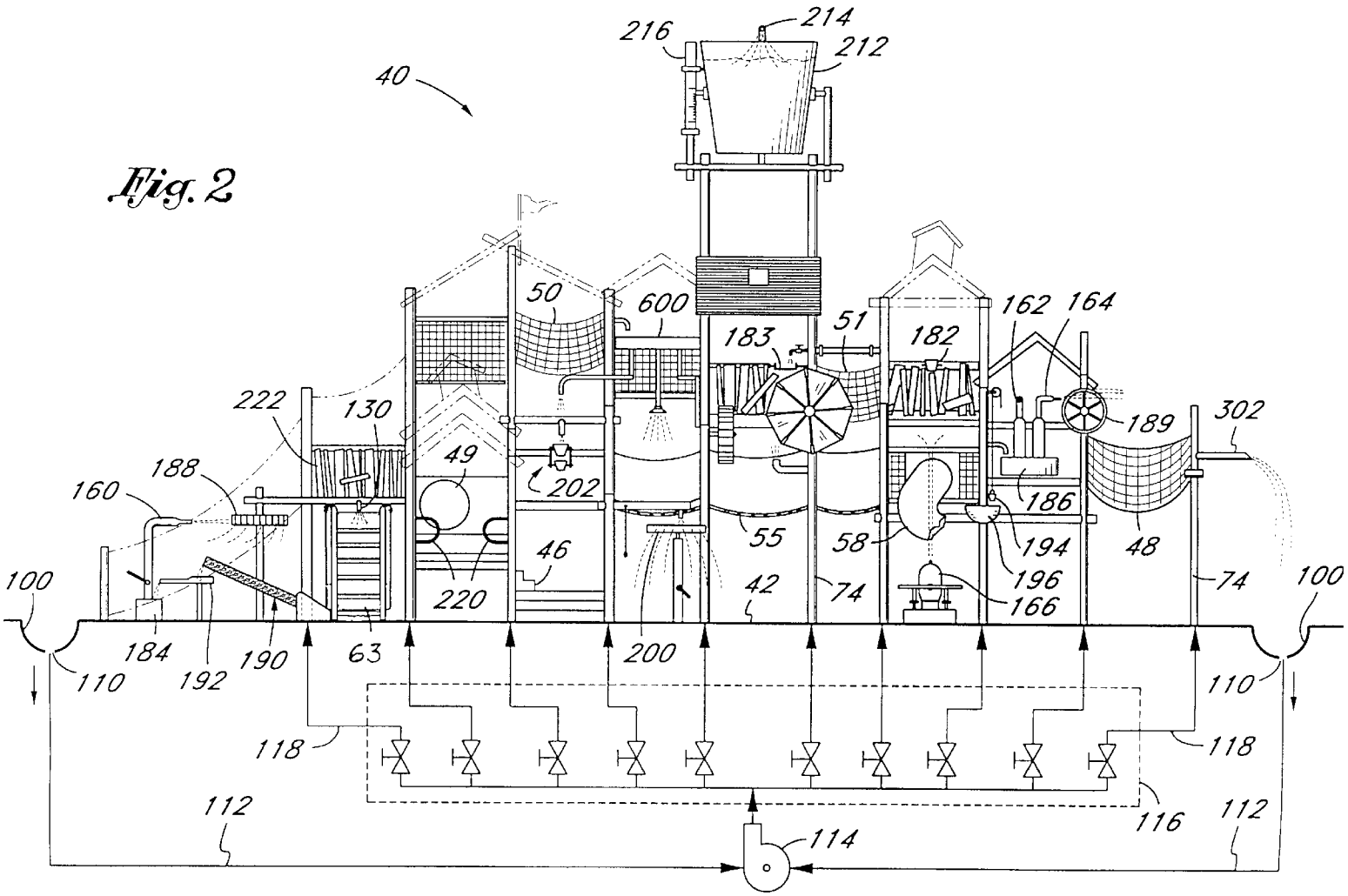
FIG. 2 is a front elevational view and schematic plumbing diagram of the participatory water play system of FIG. 1.

FIG. 2 is a front elevational view and plumbing schematic of the participatory water play system of FIG. 1. As indicated in the plumbing schematic, water under pressure is provided to the various supporting conduits 74 by a system of subterranean plumbing conduits running underneath the play structure. A pool or basin 100 is provided underneath or adjacent the play structure 40 for collecting water runoff. Drains 110 are located at various locations around the play structure 40 in order to collect the run-off water. The precise number and location of drains 110 may be varied, as desired, according to the size of the play structure 40 and the contour of the underlying terrain.

It will be appreciated that run-off water flows into the various drains 110, through the collection lines 112 to the inlet port of a recirculation pump 114. Those skilled in the art will appreciate that the pump 114 may comprise any one of a number of commercially available pumps for pumping or recirculating water. An end-suction centrifugal or vertical turbine type pump having a capacity of between about 1000 and 3000 gpm and a maximum head of between about 30 and 60 feet of water should be sufficient for most applications.

The pump 114 supplies the recirculated water at a predetermined head to a master control valve manifold 116, as shown. The manifold 116 is adapted to safely deliver the returned water via return conduits 118 to each of the vertical support conduits 74. Advantageously, the flow rate of water delivered to each of the vertical support conduits 74 may be adjusted via control valves 120 for safely supplying recirculated water to the various interconnected water effects. Those skilled in the art will readily appreciate that the above construction provides efficient reuse of water. This is desirable because, among other reasons, it reduces operating costs, promotes water conservation and avoids possibly damaging runoff water.

The vertical support conduits 74 provide water under pressure to other interconnected conduits 74 which, in turn, supply water to a variety of interconnected water forming devices and water play elements. As used herein, the term "water forming device" will refer to a nozzle or other device from which water may be caused to issue. The term "water play element" will refer to any play element that uses water and that may be manipulated or controlled by one or more play participants to create a desired water effect, such as spraying, spilling, bubbling, pouring, or splashing water. Water play elements may include, for instance, adjustable water jets or spray nozzles 130–144, pump guns or geysers 160, 162, 164, 166, 168, rotating spiralling spouts 180, tipping buckets 182, 202, tipping tray 183, or a variety of other water effects for spraying play participants or producing various water effects.

Multiple order or delayed water effects provide further challenge and excitement for play participants. For example pump guns 160, 162, 164 allow play participants to pump water from a pump basin or tub 184, 186 to form a cohesive stream of water which may be directed onto other unsuspecting play participants or may be directed to impact rotatable water wheels 188, 189, causing various desired water effects. Before the pump guns 160, 162, 164 can be activated, however, it is first necessary to provide the guns with the required "ammunition" by filling the pump basins 184, 186 with water. This may be done for instance by manipulating another valve or by operating an adjacent water effect, such as the archimedes screw pump 190 and rotatable aqueduct or trough 192, in order to fill the pump basin 184. Other play participants may form a bucket brigade using a rope-and-pulley operated bucket 194 to hoist water up from a lower basin 196 to fill the pump basin 186, which supplies the pump guns 162, 164.

In this manner, it will be appreciated that the pump guns 160, 162, 164 are "second order" water effects in that they depend on at least one other water effect to supply the guns with water. Similarly, the rotatable wheels 188, 189 are "third order" water effects in that their operation depends on two other water effects being operated either simultaneously or in secession. These rotatable wheels 188, 189 may operate or enable the operation of yet other pumps or water play elements in order to create even higher order water effects for surprising and entertaining other unsuspecting play participants. Those skilled in the art will appreciate that the number and variety of such multiple order water effects are virtually unlimited.

Other multiple order water effects may include, for instance, a pump geyser 166 for creating a vertical jet of water, a spinning water tray 200 for flinging water by centrifugal force, tandem tipping buckets 202 for showering play participants on lower levels, as well as a variety of other water effects which will be described in more detail below. Semi-active or passive water play elements, such as waterfalls 204, funnels 208, or giant tipping buckets 212 may also be used, as desired, for creating special visual effects or intermittent or random water effects for complementing a particular play theme, cooling play participants or simply adding to the overall excitement of the water play system.

For example, in the particular preferred embodiment shown a giant tipping bucket 212 is provided for periodically spilling thousands of gallons of water onto play participants below, creating dramatic visual and sound effects. Anticipation mounts as water flowing from an adjacent pipe 214 slowly fills the giant bucket 212 causing it to become topheavy and eventually spill over. A water level indicator 216 adds to the overall excitement as play participants anticipate the bucket 212 getting closer and closer to spilling. Alternatively, the giant bucket 212 may operate as a delayed water effect whereby play participants cooperate to fill or empty the giant bucket and thereby induce or prevent its spilling. Multiple buckets may be also used with teams of play participants competing to fill their bucket first and spill the contents on their competitors. Again the possibilities for multiple order or delayed water effects are virtually unlimited.

The play structure 40 also incorporates a number of non-water play elements, such as climbing nets 47, 48, webbed crawl tunnels 49–54, swinging bridges 55, and slides 56, 58–64. These provide for entertaining physical challenges as well as allowing play participants to safely negotiate their way through the various levels and platforms of the play structure 40. For instance, a through tunnel 49 allows play participants to reach the rear of the play structure 40 from the front or vice-versa. The swinging bridge 55 allows play participants to traverse between the right and left sides of the play structure 40. The use of hand rails 220, enclosure panels 222, and non-slick surfaces provides added safety in order to protect play participants from possible injury. Those skilled in the art will readily appreciate that a wide variety of other water and non-water play elements, such as funny mirrors, rotating tunnels, trampolines, climbing bars, etc., may also be incorporated into an interactive play system in accordance with the present invention, as desired.

Figure 3:
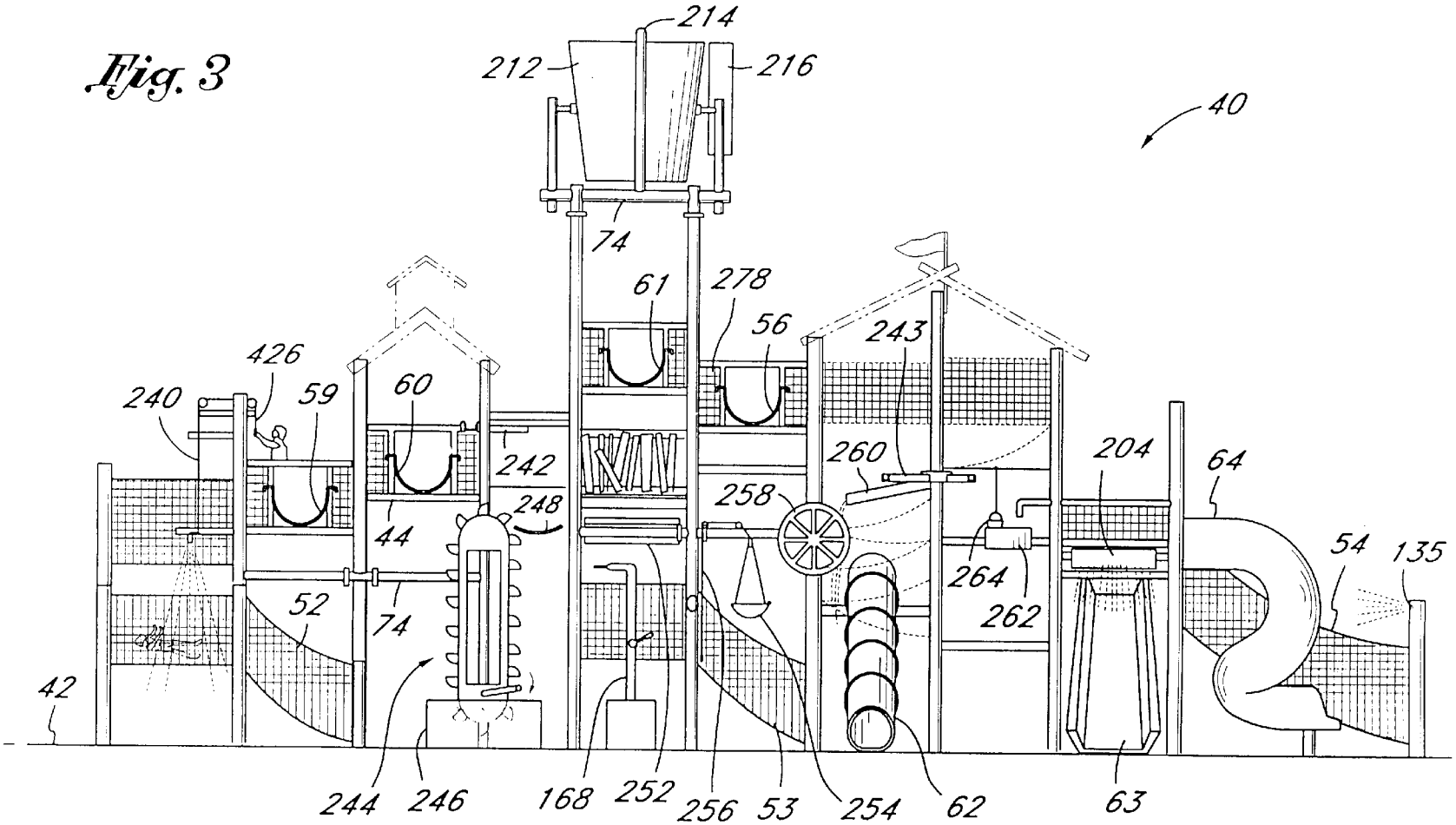
FIG. 3 is a rear elevational view of the participatory water play system of FIG. 1.

FIG. 3 is a rear elevation view of the participatory water play system of FIG. 1, illustrating additional water and non-water play elements. Starting from the left, a pull-chain activated overhead spray nozzle 240 is provided for showering play participants climbing through a crawl tunnel 52. Further to the right, pairs of trays or runnels with central sliding dams 242, 243 allow participants to choose which runnel to allow water to flow down onto others below, by sliding the dam to the opposite runnel. A bucket conveyor 244 is provided for lifting water from a lower basin 246 to an elevated aqueduct or trough 248 for supplying subsequent troughs 249, 251 or other water effects, described later. A pump gun 168 is provided for spraying a stream of water onto other play participants. Above the pump gun 168, a rain jet 252 is provided for selectively raining water down on play participants below. A hanging colander 254 is further provided which may be filled by a pull-chain activated nozzle 256. Water wheel 258 is activated by water flowing down a sloping runnel 260 which, in turn, is fed by hoisting water from a lower basin 262 using a rope-and-pulley operated bucket 264.

Throughout the play structure 40, slide entrances are provided for entering the various slides 56, 58–64. Enclosure panels or safety netting 278 is preferably provided around the various entrances to the slides 56, 58–64 in order to prevent play participants from falling off the play structure 40. Again, webbed crawl tunnels 52–54 and climbing nets 48 interconnect the various areas and levels of the play structure 40, as shown, to provide for safe travel on and about the play structure 40.

Figure 4:
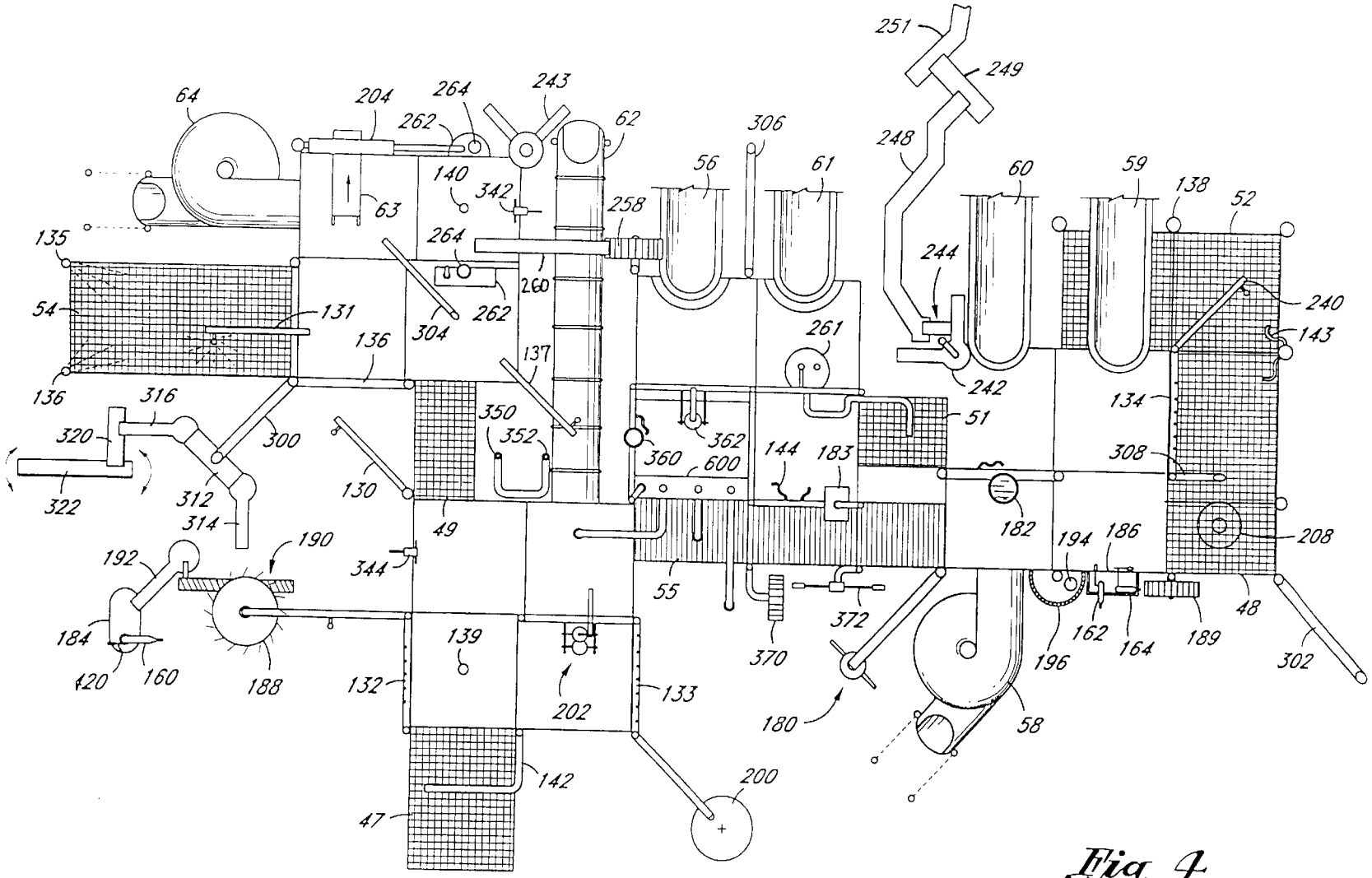
FIG. 4 is a plan view of the participatory water play system of FIG. 1.

FIG. 4 is a plan view of the interactive water system of FIG. 1, showing in more detail some of the water play elements shown in FIGS. 1–3. As indicated, dry and water slides 56, 58–64 are provided at the front, rear, and/or sides of the play structure 40. The slides 56, 58–64 may be straight, somewhat curved, or spiral-shaped in design, as shown. They may also be enclosed and tube-like, as shown, or open and exposed to water spray, as desired. Alternatively, those skilled in the art will readily appreciate that the size, number and location of the various slides 56, 58–64 can be varied, as desired, while still enjoying the benefits and advantages of the present invention.

A plurality of participant activated pipe falls 300, 302, 304, 306, 308 are provided throughout the play structure 40 for delivering water to various other multiple order water effects. One such pipe fall 300 delivers water to a tipping tray 312 which, in turn, may be positioned to deliver water to either the archimedes water screw 190 or to another series of tipping trays 314, 316 and rotatable troughs 320, 322 to create various delayed water effects. The latter can be adjusted to carry the water to remote locations such as the surrounding river loop 68. With careful planning and timing, a play participant can adjust the various tipping trays 312, 314, 316 and rotatable troughs 320, 322 to douse other unsuspecting play participants floating along the outer river loop. This encourages experimentation and learning through hands on operation of the various water play elements.

Behind the tipping trays 312, 314, 316 and rotatable troughs 320, 322 is a climbing net 54 and various spray nozzles 131, 135, 136 for selectively spraying water onto play participants climbing on the net 54. Diagonal from the climbing net 54 is provided a small slide 63 which exits through a water curtain 204. Water guns 342, 344 are provided at various locations throughout the play structure for shooting at play participants. These may either be pump guns similar to the ones described above, or they may be continuous, direct-feed guns, as desired. Preferably, at least some of the water guns 342, 344 are adapted to rotate so that they can shoot water in various directions.

A through tunnel 49 is provided from the front of the play structure to the rear, as shown. The tunnel 49 may be constructed of a relatively hard material such as a clear plastic or fiberglass, or, more preferably, it may be constructed of a soft webbing material, as indicated. The tunnel 49 terminates next to a slide 62, which exits through the back of the play structure 40, as shown. Various nozzles 137, 350, 352 are provided adjacent the tunnel 62 for spraying water onto play participants climbing in and around the tunnel 62.

Various tipping buckets 182, 360, 362 are provided on the upper levels around the play structure 40 which may be filled via an adjacent nozzle and then dumped onto play participants below. Preferably these buckets are pivotably connected to the play structure 40 by a hinge or axle so as to facilitate spilling of water from the buckets 182, 360, 362, while preventing removal of the tipping buckets and possible resulting injury. Tipping buckets 182, 360, 362 may be constructed of any convenient material, such as wood, galvanized steel, or fiberglass, as desired. Tandem tipping buckets 202 provide an added degree of skill and excitement as play participants can fill a first tipping bucket and then spill its load into second bucket, causing the second bucket to spill over or drop water onto play participants below.

Several horizontally or vertically mounted water wheels 188, 189, 258, 370, 372 are also provided throughout the play structure 40, as shown. As briefly described above, these may be activated by adjacent water effects, such as water guns 342, 344, water pumps 160, 164, 168, or runnels 260, whereby a stream of water is caused to impinge upon paddle surfaces or other impact surfaces located on or near the periphery of the water wheel 88. Alternatively, one or more of the water wheels 188, 189, 258, 370, 372 may be adapted to be operated by a nozzle or other water forming device internal to the water wheel itself. A sink with a plugged outlet 261 may be unplugged to douse participants in the tunnel 51. One or more spiralling spouts 180 may also be provided to rotate and spray water in a circular or spiraling pattern, as desired.

A variety of other water forming devices, such as overhead spray jets 130, 131, arch jets 132–134, horizontal jets 135, 136, rain jets 137, peacock jets 138, geyser jets 139–141, bar jets 142, and hose jets 143, 144, are provided throughout the play structure 40, as shown, in order to allow play participants to cool off and/or douse one another with water spray in a fun and entertaining way. Control valves 400, 402, 404 and actuators 256, 420–422, 424, 426, 428, for example, for the various water forming devices, may be operated by play participants to control the flow of water issuing from the various water forming devices. Control valves may include, for example, wheel-controlled butterfly valves, lever-controlled butterfly valves, counter-weight valves, gate valves, flush valves, wheel-controlled ball valves, lever-controlled ball valves, and any number of other control valves well know to those skilled in the art. Actuators may include pump levers, hand cranks, pull chains, and other actuators well known to those skilled in the art.

Figure 5:
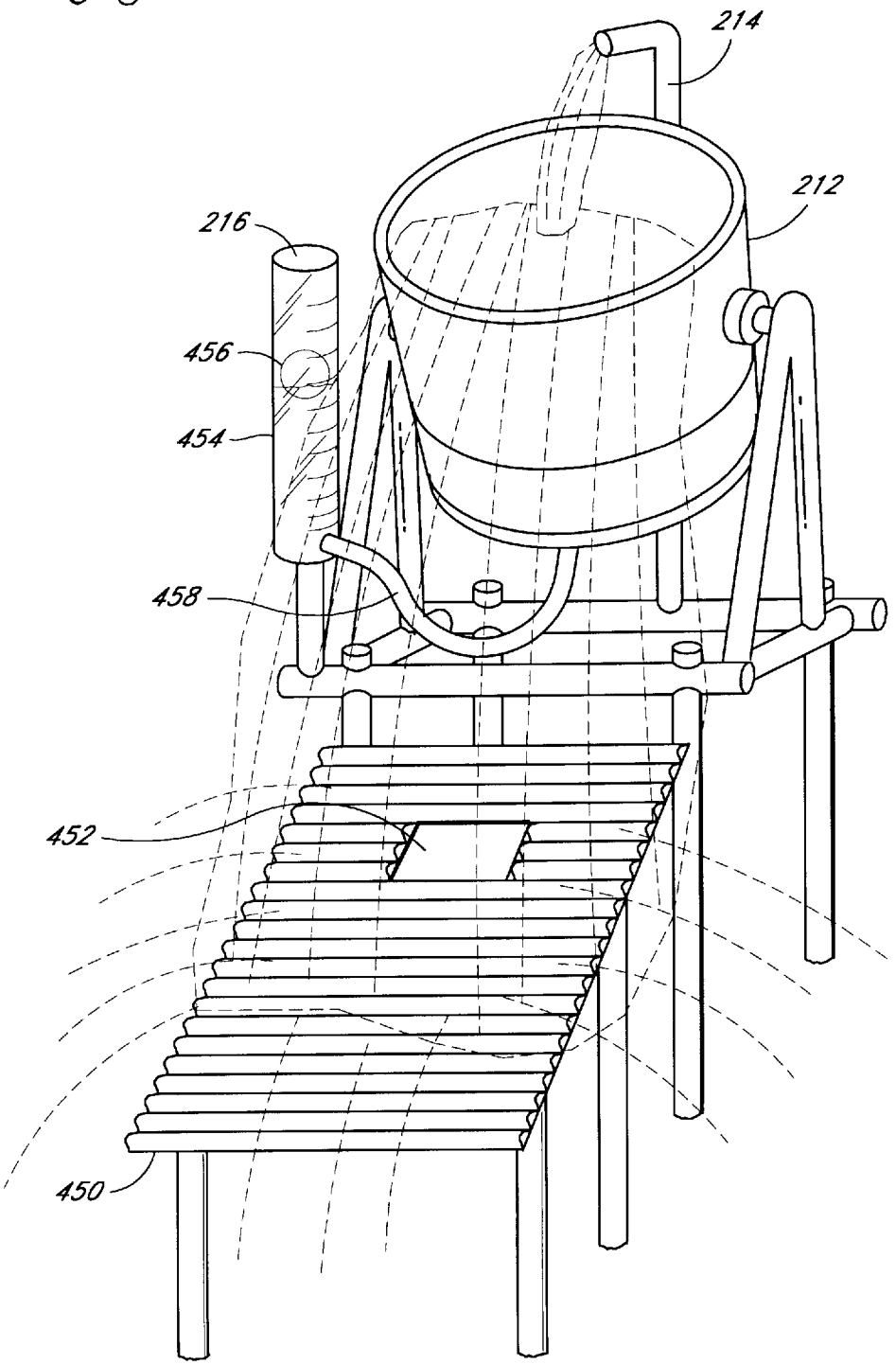
FIG. 5 is a front perspective view of a participatory water play element in the form of a giant spilling bucket.

Referring to FIG. 5, a dominant feature of the participatory water play system of FIGS. 1–4 is a giant bucket 212 balanced on top of the play structure 40. The bucket 212 is preferably about 40 feet tall and is pivotably mounted on the play structure 40 such that when it is filled with water the bucket becomes unstable and tips forward, spilling its load of about 1000 gallons of water on play participants below.

To accomplish this dramatic water effect, the giant bucket 212 is pivotably mounted so as to be conditionally stable when empty or filled to less than full capacity. In its stable condition, the pivot axis of the bucket is above the combined center of gravity of the bucket 212 and the water contained in the bucket. When the water level in the bucket 212 reaches a certain level, however, the combined center of gravity of the bucket 212 and the water becomes elevated to a point above the pivot axis. This causes the bucket to become unstable and to eventually spill. The conditions for stability and direction of spilling can each be controlled by selectively weighting the bucket to slightly bias it forwards or backwards, as desired. Alternatively, the bucket 212 may be mounted slightly off axis in order to bias it in a particular desired direction.

The particular shape of the giant bucket 212 may be varied, as desired, to accommodate different size play structures 40 and different play themes. For instance, a skull-shaped bucket, described later, provides an exciting complement to a pirate ship adventure theme. The size and capacity of the bucket 212 can also be varied, as desired, to achieve various dramatic water effects. While virtually any size or shape bucket may be used to create various dramatic water effects, a bucket 212 having a preferred height of between about 10 and 100 feet and a preferred capacity of between about 100–3000 gallons should provide adequate results for most applications.

The bucket 212 is filled by water flowing from a pipe or spout 214. Depending upon the desired effect, this water flow may either be passive-continuous, passive-intermittent, or partially or fully active (i.e., controlled by play participants). In the particular embodiment shown, the water flow from the pipe 214 is substantially passive-continuous such that the bucket fills up and spills over at fairly regular intervals. Alternatively, it is envisioned that the water flow into the bucket 212 may be intermittent or random such that spilling of the giant bucket 212 occurs at unpredictable intervals. In a second alternative embodiment, it is envisioned that the giant bucket 212 may operate as a delayed water effect whereby play participants cooperate to fill or empty the giant bucket 212 and thereby induce or prevent its spilling. Multiple buckets 212 may be also used with teams of play participants competing to fill their bucket first and spill the contents on their competitors.

The immense quantity of water contained in the bucket 212 falls onto a deflection shield 450, as shown, causing the water to splash and disperse widely. This is primarily a safety measure to mitigate the direct impact of the water on play participants. However, the impact of thousands of gallons of water on the deflection shield 450 also creates dramatic visual and sound effects. These can be varied by changing the shape of the deflection shield 450, its angle of orientation, and the particular materials used to construct the deflection shield 450.

Preferably, the deflection shield 450 is constructed of a heavy-duty corrugated material, such as galvanized steel, aluminum, or fiberglass, in order to support the immense weight of the impacting water and to thoroughly disperse the water. Similar desirable effects may be achieved using wood or fiberglass slats, as desired. Adequate dispersion and sound effects have been achieved using corrugated 18–26 gauge galvanized steel and, more preferably, 20 gauge galvanized steel, with the corrugated folds running transverse to the water flow. Mounting the deflection shield 450 with a downward slope of between about 30 and 45 degrees provides further dispersion of water. Alternatively, a curved convex or concave deflection shield can also be used, as desired, to create various desired water effects.

One or more optional openings 452 may be provided in the deflection shield 450, as shown, for allowing at least a portion of the spilling water to directly impact play participants standing on the platform immediately below the opening 452. These openings 452 may either be fixed in size or they may be adjustable via a sliding door or equivalent device well known in the art. Preferably the openings 452 are of sufficient size and shape to allow significant amounts of water to enter and splash about the play structure 40, but not so large as to injure play participants or cause them to be swept over the side of the play structure. A single rectangular opening 452 having an open area of between about 2–8 square feet provides an adequate compromise for most applications. Of course larger or smaller openings having various other shapes may also be used, as desired. Optional baffles may also be provided in the path of water flow through the opening 452 in order to mitigate the impact of water on play participants standing immediately below the opening 452.

An optional fill level indicator 216 may be located adjacent the bucket 212 to indicate the level of water accumulating in the bucket 212. The fill level indicator comprises a clear plastic tube 454 and a brightly colored ball 456 which is disposed to float within the tube 454. Water from the bucket 212 enters the tube 454 through a flexible hose 458 or other water conduit, causing the tube 454 to fill with water in accordance with the level of water in the bucket 212. Persons skilled in the art will appreciate that the floating ball 456 will float on top of the water in the tube 454 and the height of the ball will indicate the corresponding water level in the bucket 212.

The water level indicator 216 adds to the excitement of the giant spilling bucket effect because play participants quickly learn to watch the ball 456 in order to predict when the bucket will eventually spill. Participants can then decide whether to seek cover or possibly expose themselves to the downpour of water spilling from the bucket 212. Those skilled in the art will readily appreciate that a wide variety of water level indicators 216 may be used to enjoy the full benefits and advantage of the present invention.

The following FIGS. 6–16 illustrate in more detail some of the various participatory water play elements that may be used in a participatory water play system constructed in accordance with the present invention. The drawings and descriptions are provided only as examples of the types of participatory water play elements that may be used to practice the present invention, and should not be construed as limiting in any way the scope of the claimed invention.

Figure 6:
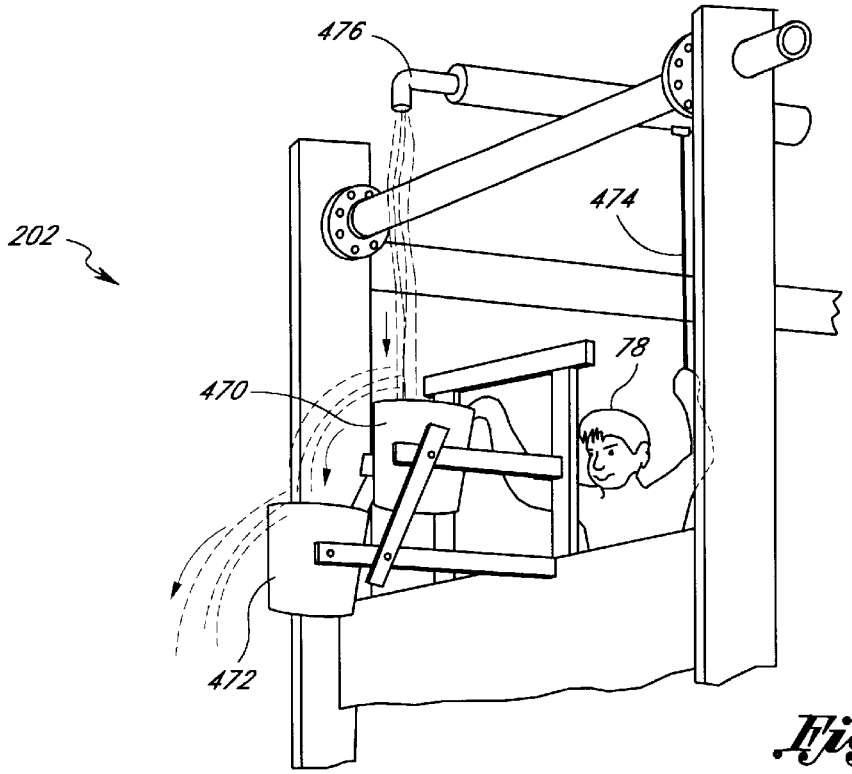
FIG. 6 is a front perspective view of a participatory water play element in the form of tandem tipping buckets.

FIG. 6 shows tandem tipping buckets 202. These participatory water play elements allow a play participant 78 to fill one bucket 470 and cause it to spill into another bucket 472 below. The lower bucket 470 can then spill its contents into yet another bucket, similar to a domino effect, or it can spill onto play participants, below. The buckets 470, 472 are preferably conditionally stable so that they will spill over when the water in the bucket reaches a certain level. Alternatively, one or more of the buckets 470, 472 may be stable such that they must be tipped by hand.

A pull chain operated valve 474 allows the play participant 78 to control the water flowing from an overhead nozzle 476, as shown. This water may be used to fill the first tipping bucket 470, as shown. When the upper bucket 470 fills to a certain level, it tips over and fills the lower bucket 472. The lower bucket 472 can either tip over and spill its contents immediately, or one or more holes may be provided in the lower bucket 472 for showering play participants below.

The buckets 470, 472 may be weighted, as desired, to ensure that the buckets tip in a particular direction. Alternatively, one or more of the buckets may be allowed to tip in either direction to create a random water effect. Tipping trays, rotating troughs or additional tipping buckets may be added to create a cascading domino effect as buckets successively fill and spill over into other buckets or water containing elements. Multiple cascading paths may also be provided to increase the randomness or excitement of the overall water effect. For extremely high order water play effects (eg. chained reactions exceeding about ten) it may be necessary to adjust the size or capacity of the various tipping buckets or other water effects to accommodate for spillage at each stage in the chain reaction.

Figure 7:
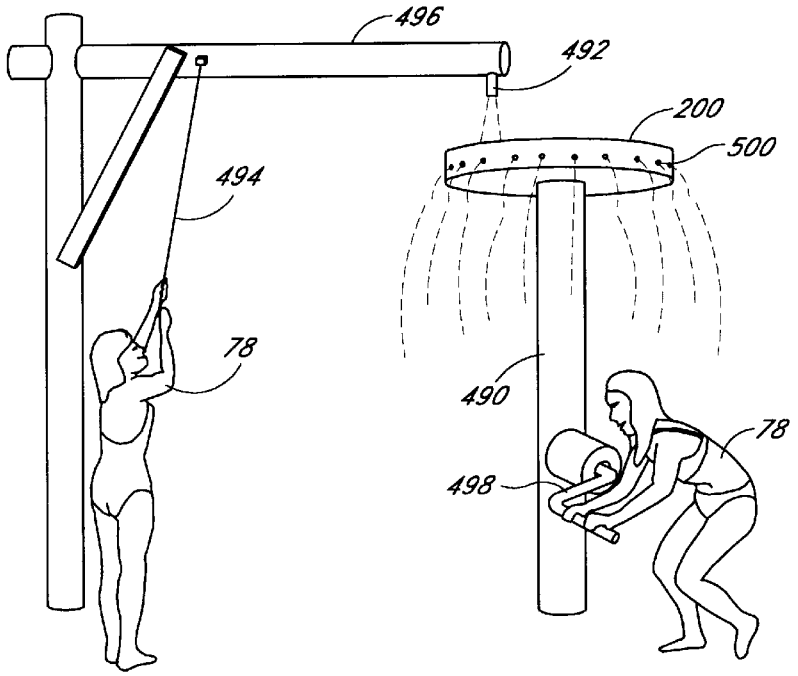
FIG. 7 is a front perspective view of a participatory water play element in the form of a spinning water tray.

FIG. 7 shows a spinning water tray 200, located atop a support post 490. The spinning water tray 200 is filled with water via a spray nozzle 492 which is activated by a pull chain 494. This may either be performed simultaneously with the operation of the water tray 200, as shown, or it may be performed in succession. The nozzle 492 is supported above the water tray 200 by a pipe boom 496, as shown. Water flowing from the nozzle 492 fills the tray 200 while another participant cranks a handle 498 mounted on the support post 490 to spin the tray.

Those skilled in the art will readily appreciate that the handle 498 is adapted to turn a series of gears contained in the post 490, which causes the tray 200 to rotate. The resulting centrifugal force on the water in the tray 200 causes jets or streams of water to fling out from a plurality of holes 500 provided along the periphery of the tray 200. The faster the handle 498 is cranked, the greater will be the centrifugal force on the water on the tray 200 and the distance which the water will be flung.

The spinning water tray 200 is a second order water play effect in that it depends on another water play effect, namely the pull-chain activated spray nozzle 492, to supply it with water. These two related water effects may be activated in secession by one or more play participants or, alternatively, they may be activated simultaneously by two or more play participants, as shown, cooperating to create the desired effect. Continuous operation of the spinning water tray effect 200, however, requires the participation of at least two play participants, as shown. This allows play participants to interact with one another and learn basic concepts of teamwork and cooperation.

Figure 8:
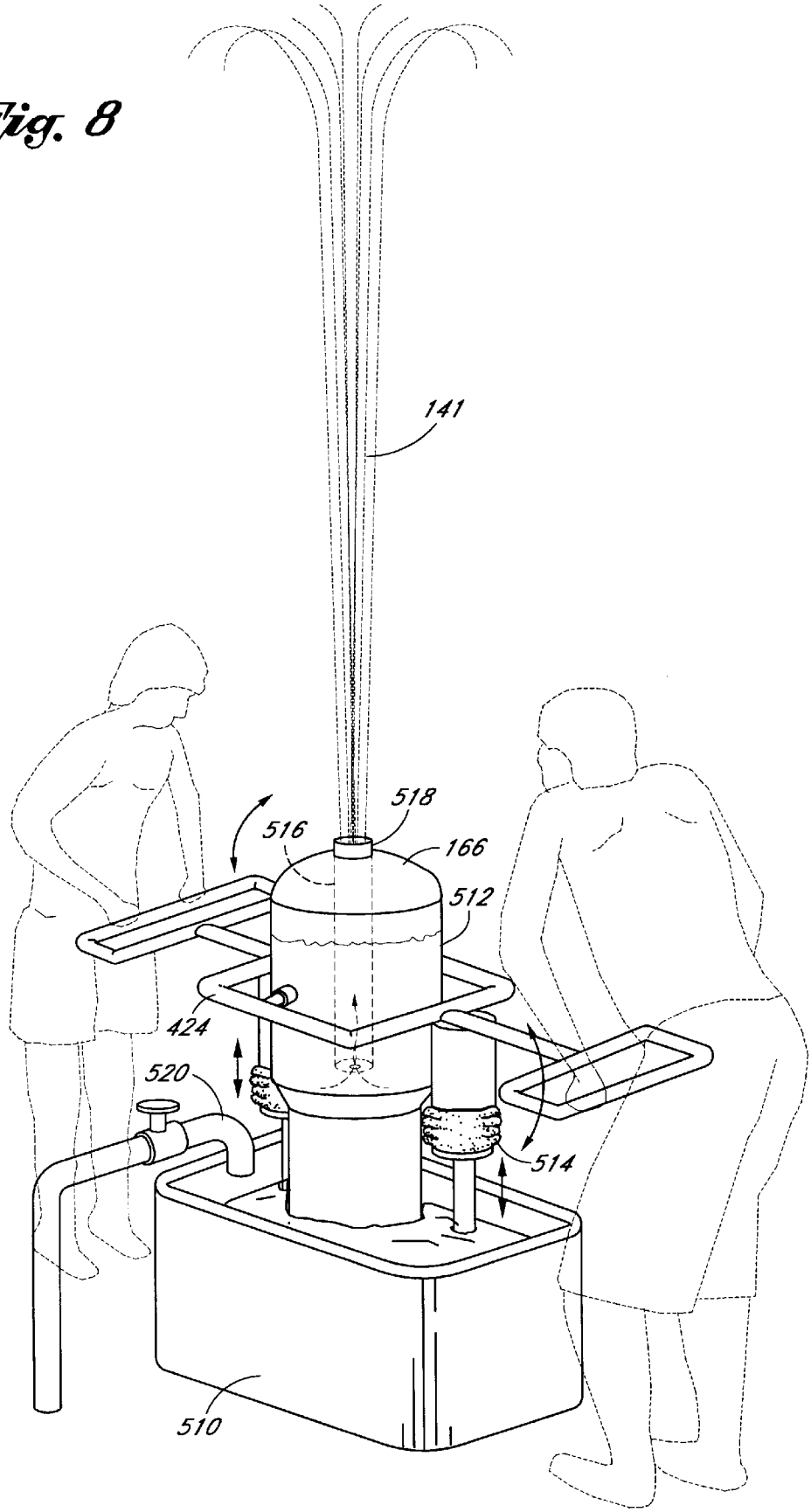
FIG. 8 is a front perspective view of a participatory water play element in the form of a pump-operated water geyser.

FIG. 8 shows a pump-operated geyser 166 for pumping water from a pump basin 510 and shooting it upwards in a vertical stream simulating a geyser 141. The pump geyser 166 comprises a sealed pump housing 512 adapted to contain air and water under pressure. The air may either be in direct contact with the water, or it may be separately sealed in compressible air bladder or other container well known to those skilled in the art. A two-man pump actuator 424 may be manipulated by one or more play participants, as shown, to pump water under pressure into the pump housing 512. This is preferably accomplished using any one of a number of positive displacement pumps that are well known in the art, such as a piston-and-cylinder type pump or, as illustrated here, a pair of compressible pump bladders 514.

As the water fills the pump housing 512, it displaces the air contained within the pump housing 512, causing it to be compressed. As the pressure in the pump housing 512 continues to build, water in the pump housing 512 is forced up through a draft pipe 516 exiting through the vertical nozzle 518, forming a vertical stream of water 141. The resulting geyser jet 141 can be seen, felt, and heard by other play participants nearby. The harder and faster the play participants pump the actuator 424, the higher the pressure will be in the pump housing and the more dramatic the water effect.

As with the spinning water tray 200, described above, the pump geyser 166 is also a second order water play effect in that the tub or basin 510 must first be filled by activating an adjacent nozzle 520, or by manipulating other interactive water effects (not shown) to deliver water to the pump basin 510. This may be done in succession or simultaneously. In this manner, the pump geyser 166 also promotes teamwork and cooperation in order to achieve desired water effects.

Figure 9:
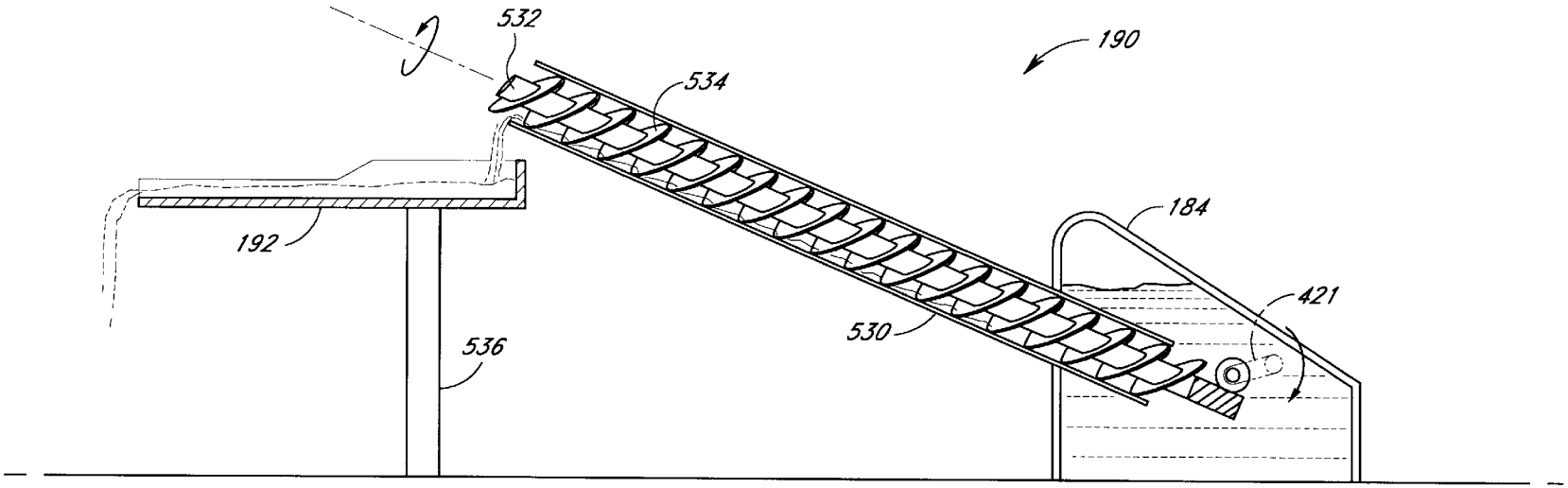
FIG. 9 is a partial front cross-sectional view of a participatory water play element in the form of an archimedes water screw.

FIG. 9 shows an archimedes water screw 190, which play participants may operate to transport water from a pump basin 189 to one or more other water play elements, such as rotatable trough 192, as shown. The archimedes screw 190 comprises a clear plastic cylinder 530 in which is disposed a screw or auger 532. The screw 532 has threads 534 which wind upward from the bottom of screw 532 to the top. The threads 534 are maintained in substantially close proximity with the inner wall of the cylinder 530 so as to prevent significant water flow between adjacent screw threads 534.

A crank handle 421 is provided near the base of the screw 532 and is adapted to be turned by a play participant. Those skilled in the art will readily appreciate that the handle 421 is adapted to turn a series of gears or other drive mechanisms well known in the art, which cause the screw 532 to rotate, thereby lifting water upward along the cylinder 530. The water contained in the pump base 184 is thus carried upward by the threads 534 of the screw 532 until the water reaches the top of the cylinder 530 and spills out into the rotatable trough 192 or other water play element, as desired.

The trough 192 may be pivoted about its base 536 to cause water to flow into yet another trough and then to another pump basin to eventually provide water for yet another participatory water play element. Thus, it will be appreciated by those skilled in the art that the archimedes water screw 190 may form but one part of a more complex water play effect that is comprised of a sequence of smaller effects each operated by a number of different play participants cooperating together to create an overall desired water effect.

Figure 10:
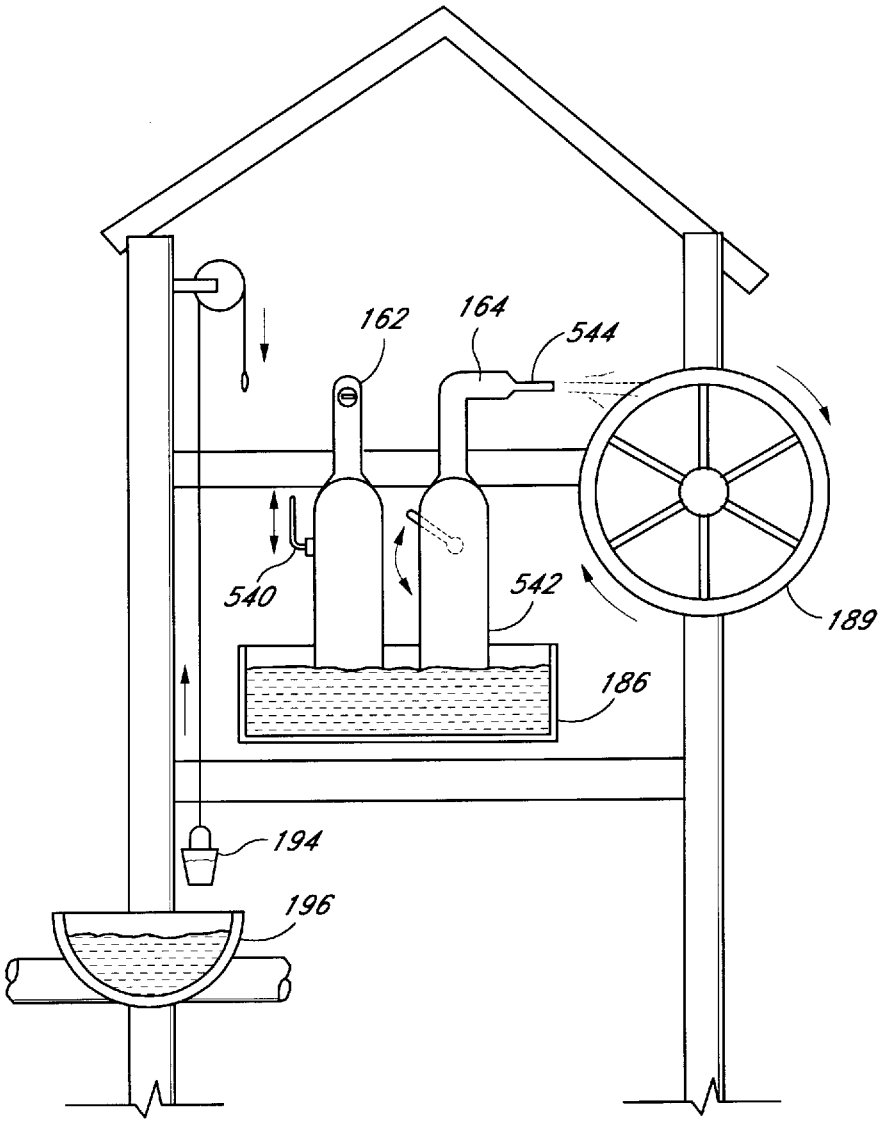
FIG. 10 is a front elevational view of various participatory water play elements in the form of pump guns, a spinning water wheel and a rope-and-pulley operated bucket.

FIG. 10 shows a pair of pump guns 162, 164. One pump gun 162 is directed outwardly. The other pump gun 164 is directed toward a nearby water wheel 189. The pump guns 162, 164 allow play participants to pump water from a pump basin 186 to form a stream of water which may be directed onto other play participants below or onto a rotatable water wheel 189, causing various desired water effects.

Each of the guns 162, 164 is activated a hand-actuated lever 540 which may be manipulated by play participants to operate a pump (not shown) disposed within a pump gun housing 542. The pump may be of any one of a number of positive displacement type pumps well known in the art. It will be appreciated by those skilled in the art that the pump syphons water from the basin 186 and sprays it out of a water gun nozzle 544, as shown.

Before the pump guns 162, 164 can be activated, however, it is first necessary to provide the guns with "ammunition" by filling the pump basin 186 with water. In the preferred embodiment, this is done by using a rope-and-pulley operated bucket 194 to hoist water up from a lower basin 196. Specifically, water from the bucket 194 may be used to fill the pump basin 196 in order to supply the pump guns 162, 164. Alternatively, those skilled in the art will appreciate that any number of other water effects, such as a spray nozzle, archimedes screw, or rotatable trough may be used to supply the pump guns 162, 164 with water.

Figure 11:
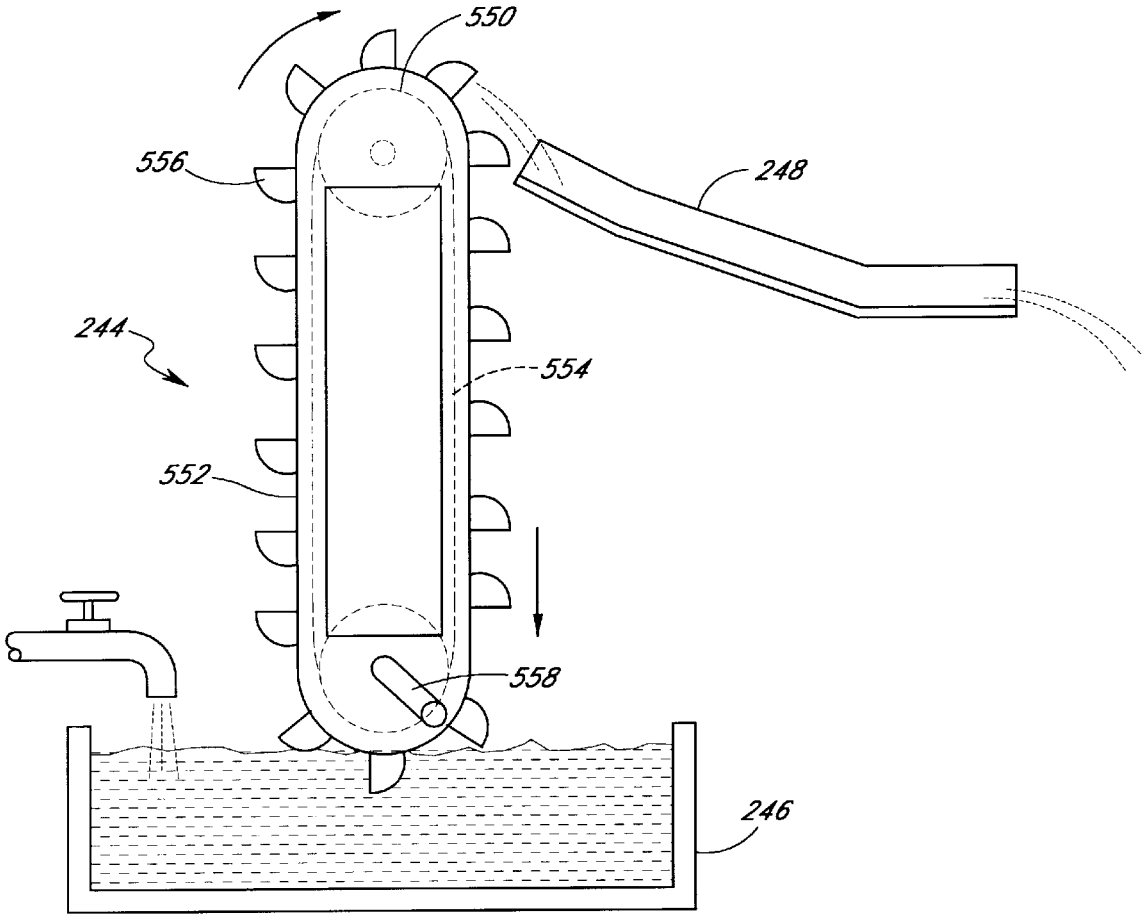
FIG. 11 is a front elevational view of a participatory water play element in the form of a bucket conveyor.

FIG. 11 illustrates a bucket conveyor 244. The bucket conveyor 244 comprises a pair of opposed pulleys or sprockets 550 supported in a frame 552. A chain or rubberized belt 554 is supported between the two pulleys 556 such that the belt 554 is under a predetermined amount of tension. Attached to the chain or belt 554 are a plurality of spoons or buckets 556 for containing water. A crank handle 558 is provided at the base of the frame 552 for causing the lower pulley to rotate.

Those skilled in the art will appreciate that the crank handle 558 is adapted to drive the pulley 550 through a direct drive mechanism or an associated gear train. As the crank handle 558 is turned, the pulley 550 turns clockwise, carrying the belt 554 around with it. This causes the buckets 556 on the left hand side of the conveyor 244 to rise up, lifting water from the basin 246 and dumping it into the adjacent trough 248 or other water container, as desired. Again, it will be appreciated that the bucket conveyor 244 may form one part of a larger, more complex water play effect that is comprised of a number of smaller effects each operated by different play participants cooperating together to create an overall desired water effect.

Figure 12:
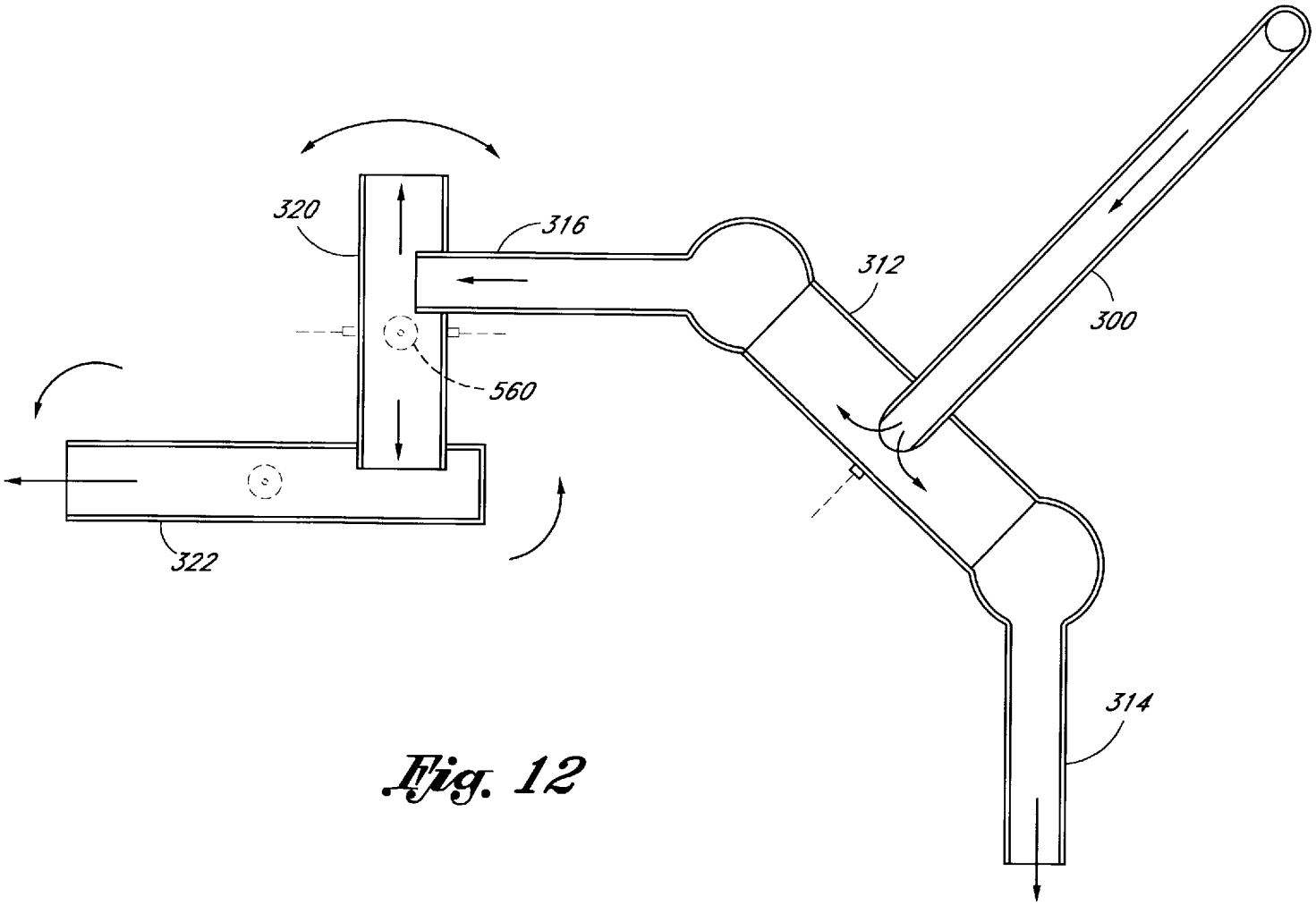
FIG. 12 is a top plan view of various participatory water play elements in the form of interconnected tipping trays and rotatable water troughs.

FIG. 12 illustrates a network of tipping trays 312, 314, 316 and rotatable troughs 320, 322 which may be used to create various desired water effects. A runnel or pipe fall 300 delivers water to a first tipping tray 312 which, depending upon its tipped position, can feed water to either of two troughs 314 or 316. One trough 314 provides water to another water play effect (not shown). The other trough 316 provides water to a second tipping tray 320 which is also adapted to rotate about a base 560. Depending upon the tipped and rotational positioning of tipping tray 320, water can be delivered to other water effects, spilled onto the ground or lower play levels, or can be delivered to a rotatable trough 322, as shown. Those skilled in the art will readily appreciate that a number of such rotatable troughs and tipping trays may be used to form a Rube Goldberg-like network of interconnected water effects whereby water may be caused to follow a highly circuitous path from one elevation to a lower elevation, flowing through various, trays, troughs, runnels and other water effects, as desired.

The various tipping trays and troughs may also be used to create delayed water effects. For instance, the various troughs and tipping trays may be adjusted to carry water to remote locations, such as a surrounding river loop (not shown). With careful planning and timing, a play participant can adjust the various tipping trays and rotatable troughs to douse other unsuspecting play participants floating in the river loop. This encourages experimentation and learning through hands on control of the various water effects.

Figure 13:
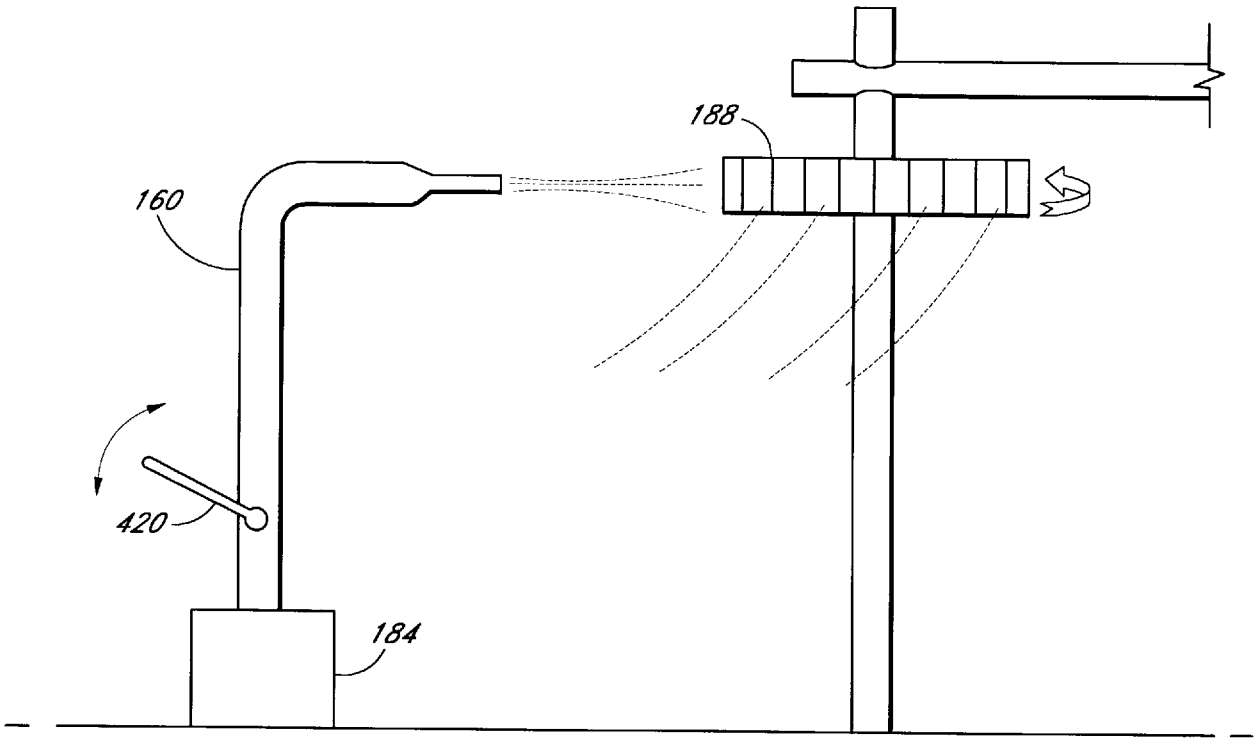
FIG. 13 is a front elevational view of a participatory water play element in the form of a pump gun and a horizontal water wheel.

FIG. 13 shows another pump gun 160 which play participants may operate to shoot a stream of water at a horizontal water wheel 188. The pump gun 160 may be operated substantially as described above in connection with FIG. 10. However, in this case the stream of water sprayed from the pump gun 160 impinges a horizontal water wheel 188, creating a unique water effect which spreads out away from the water wheel 188 wetting nearby play participants.

Figure 14:
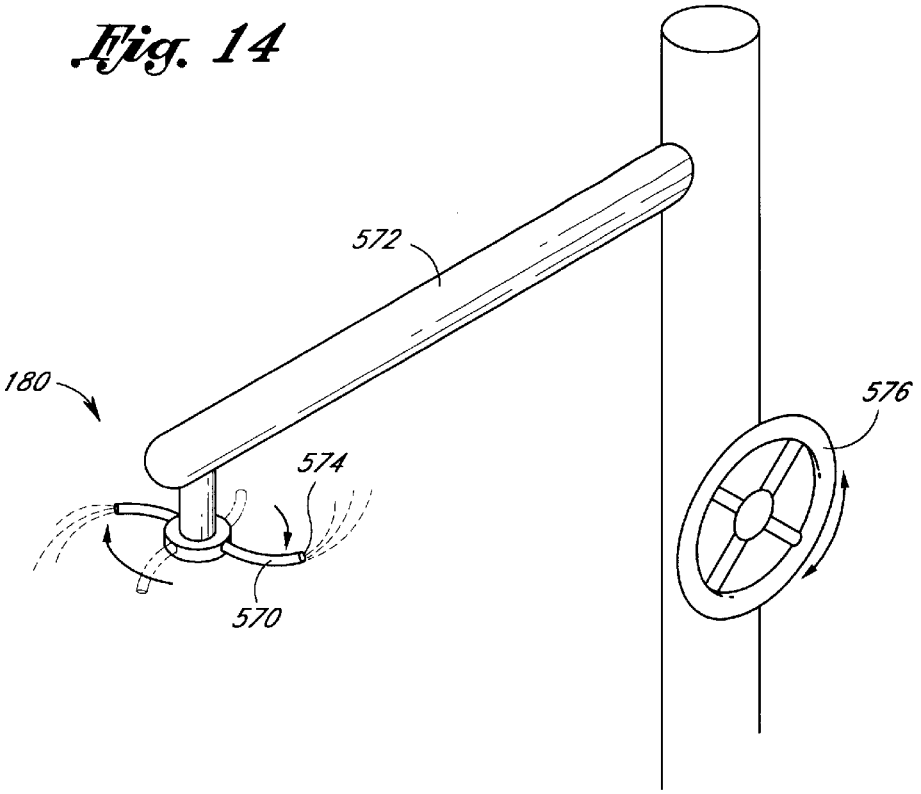
FIG. 14 is a perspective view of a participatory water play element in the form of a spiralling water spout.

FIG. 14 shows a spiralling water spout 180. It comprises at least two or more arms 470 rotatably mounted on a supporting water pipe 572, as shown. Each of the arms has an aperture or nozzle 574 for allowing water to exit and spray out. The arms 570 are preferably slightly bent or curved, as shown, such that the momentum of the exiting water causes the water spout to rotate, creating spiraling water effect. The speed and intensity of the water spout 180 may be controlled by adjusting an adjacent control valve 576, as shown. It will be appreciated by those skilled in the art that spiraling water spouts having multiple additional arms 570 or multiple spray apertures 574 may be also used, as desired, while still enjoying the benefits and advantages of the present invention. Likewise, the spiraling water spout 180 may be mounted for downward or upward spray patterns, as desired.

Figure 15:
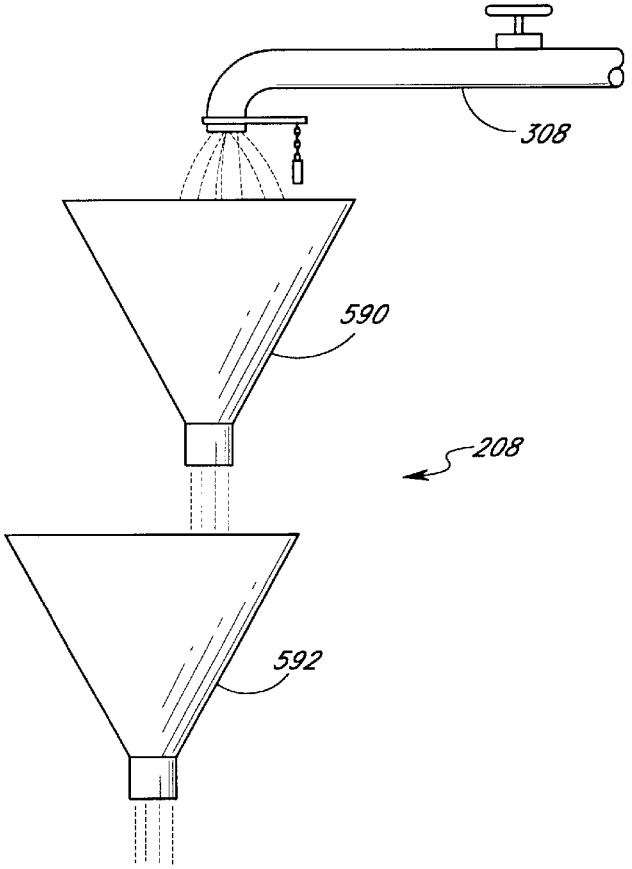
FIG. 15 is a perspective view of a participatory water play element in the form of funnels.

FIG. 15 shows a pair of funnels 208. The funnels 208 are mounted one on top of the other, as shown. Water from an adjacent water effect 308 flows into the large end of the first funnel 590, as shown, at least partially filling the funnel. This causes water to drain through the small end of the first funnel 590 into the large end of the second funnel 592. The apertures formed at the small ends of the funnels 590, 592 are preferably small relative to the quantity of water that may be received such that play participants may observe and experiment with the effects of flow restriction. Other entertaining water effects may be achieved by varying the relative sizes of the funnels 590, 592, adding more funnels, or mounting the funnels in unique or unusual ways. Hyperbolic funnels may also be used to create various spiralling water effects, as desired.

Figure 16A:
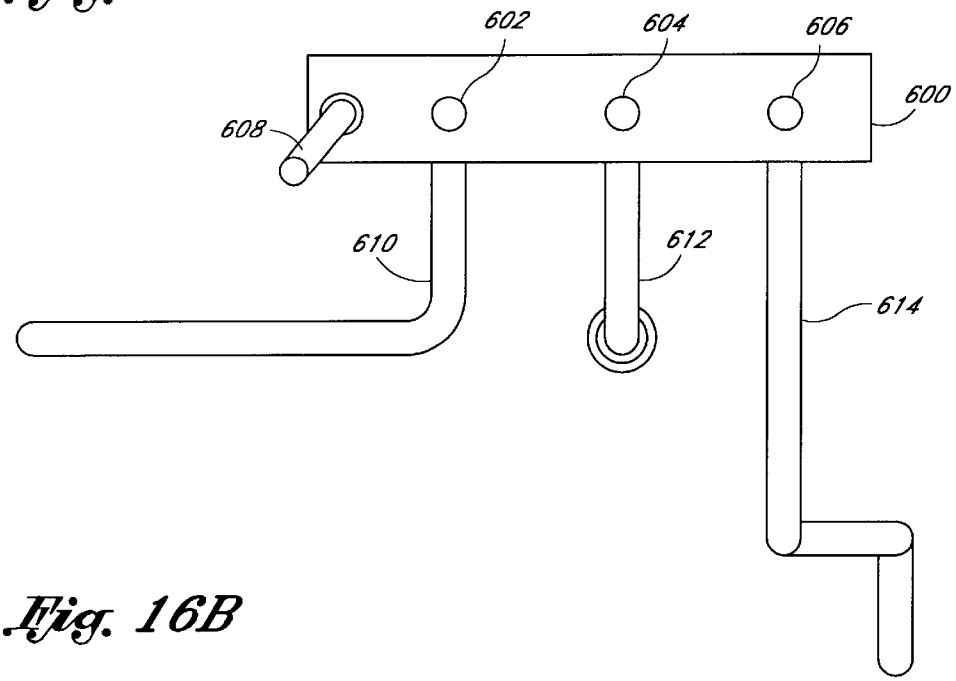
FIGS. 16*a–b* are top plan and front elevational views, respectively, of a participatory water play element in the form of a play sink having multiple outlets adapted to be plugged or unplugged.
Figure 16B:
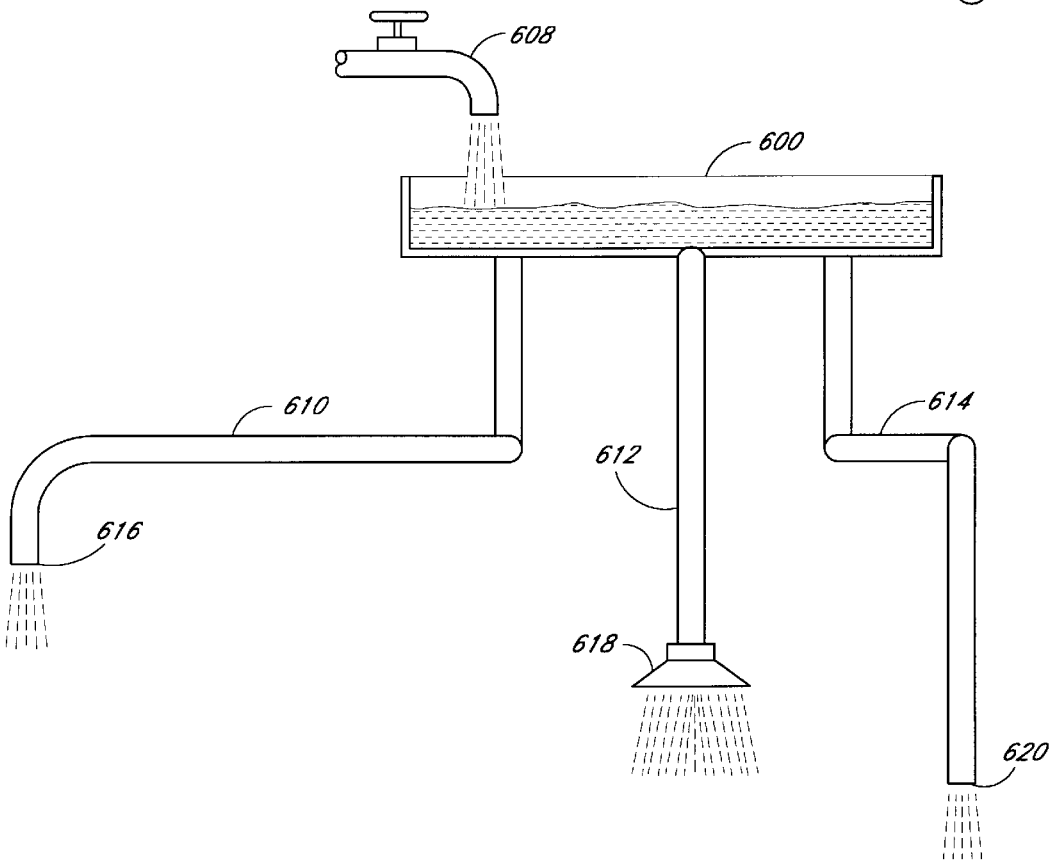

FIGS. 16*a* and 16*b* show plan and front elevational views, respectively, of a play sink 600 having multiple outlets 602, 604, 606, some or all of which may be closed or plugged. Water from an adjacent water effect 608 fills the sink basin 600. The sink 600 continues to fill with water until it either overflows or until a play participant unplugs one or more of the outlets 602, 604, 606. Unplugging any of the outlets 602, 604, 606 causes the water to exit through a corresponding pipe 610, 612, 614 located beneath the sink 600. These pipes 610, 612, 614 are configured to deliver the sink water to various shower heads 616, 618, 620, respectively, located in other, possibly remote, areas of the play structure. This allows play participants to mount surprise attacks on other play participants, since victims caught standing underneath the shower heads 616, 618, 620 will not know where the water came from or who caused it to be delivered.

FIGS. 17*a–g* illustrate several preferred types of water jets and nozzles which may be used in a participatory water play system of the present invention. Again, these are examples only and should not be construed as limiting the claimed invention in any way.

Figure 17E:
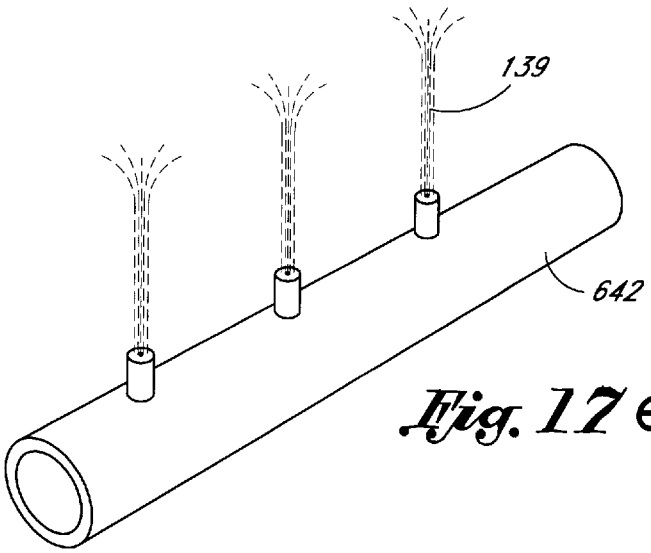
Figure 17F:
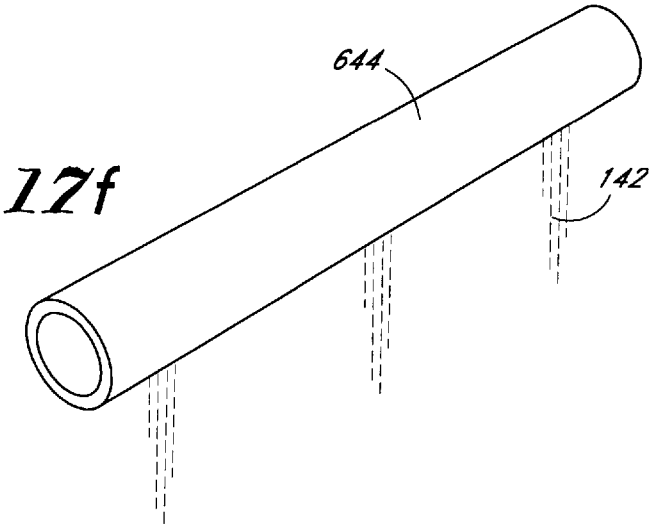
Figure 17G:
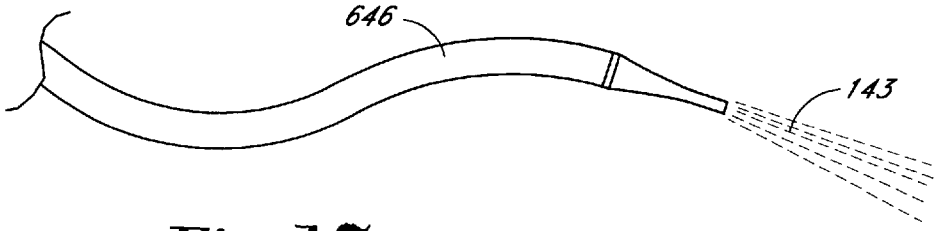

FIG. 17*a* shows an arch jet 132 formed from a nipple nozzle 630 extruding from a horizontally oriented section of pipe 632. The arch jet 132 is preferably formed with the nozzle 630 at a 45 degree angle from the horizon. FIG. 17*b* shows horizontal jets 135 which are formed from nipple nozzles positioned at apertures 634 of a vertically oriented pipe 636. FIG. 17*c* shows rain jets 137 formed by nozzles disposed at the bottom of a pipe 638, such that a water spray simulating rain droplets results. FIG. 17*d* shows a curved pipe section 640 having nipple nozzles forming peacock jets 138. FIG. 17*e* shows geyser jets 139 formed by nipple nozzles extending vertically upward from the horizontal pipe 642. FIG. 17*f* shows another horizontal pipe 644 having nipple nozzles forming bar jets 142, comprising separate tightly flowing streams. FIG. 17*g* shows an attack hose 646 and spray jet 143 which can be freely manipulated by the play participants to spray others at will. Other spray patterns may be formed using various other types of nozzles or water forming devices well known to those skilled in the art.

Figure 18:
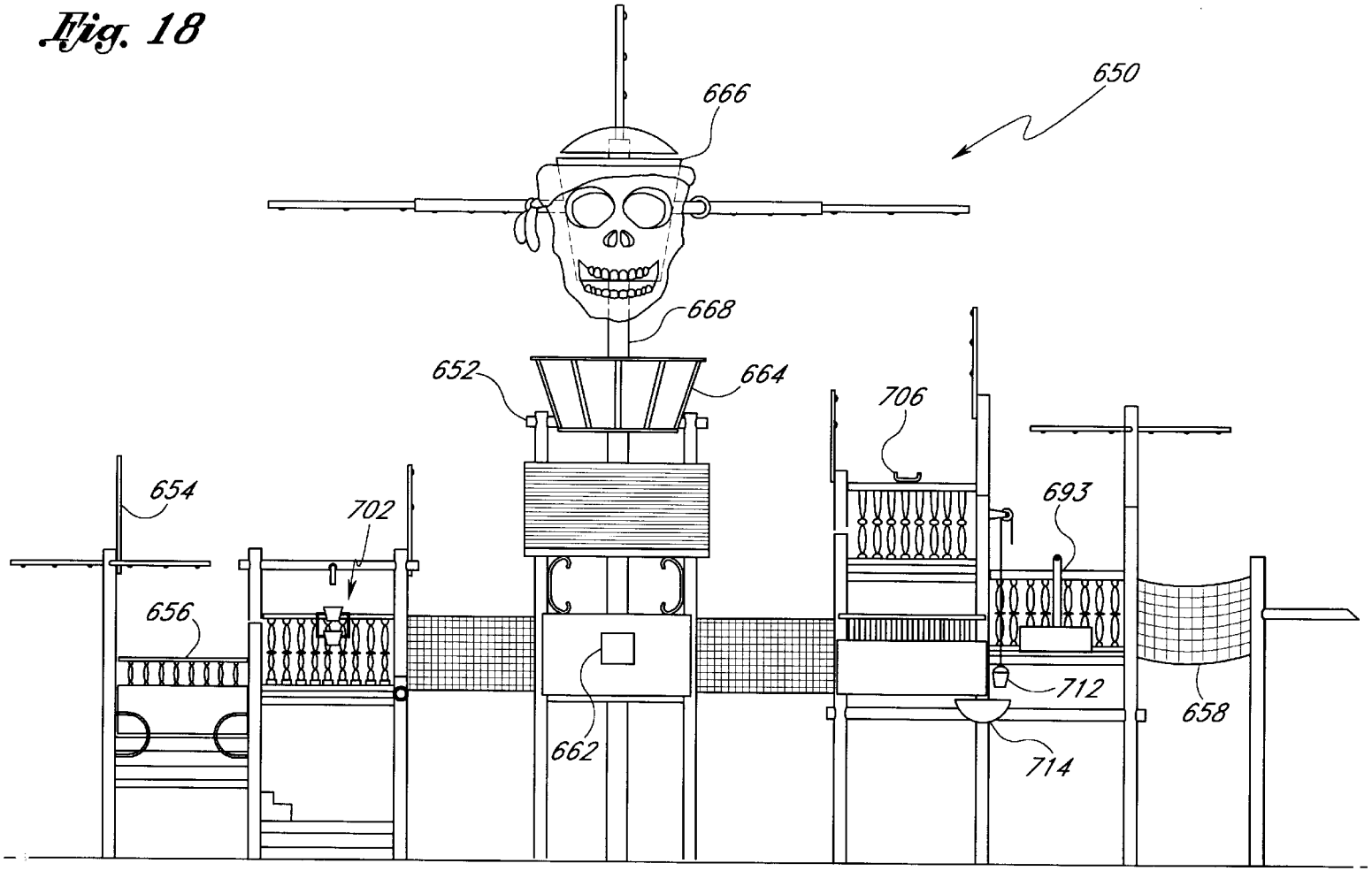
FIG. 18 is a front elevational view of an alternative preferred embodiment of a participatory water play system having features of the present invention.

FIG. 18 shows an alternative preferred embodiment of a participatory water play system having features of the present invention. This particular water play system is provided in the form of a pirate ship adventure theme. The multi-level structure 650 comprises numerous water and non-water play elements, similar to those described above.

These are positioned at each elevation and are adapted to allow play participants to act out an imagined pirate adventure.

In keeping with the pirate adventure theme, the supporting framework 652 of the structure 650 incorporates the look of ship's masts 654 and has spindle-style railings 656, as well as net ladders and bridges 658. Water cannons 660, 661 shoot out of cannon portholes 662 located around the structure 650. A crow's nest 664 is included beneath the bucket 666, as shown. A skull-shaped bucket 666 at the top of a mast 668 completes the theme. As with the giant bucket effect described above, this bucket is adapted to periodically spill nearly 1000 gallons of water on top of the play structure 650, creating dramatic visual and sound effects.

Figure 19:
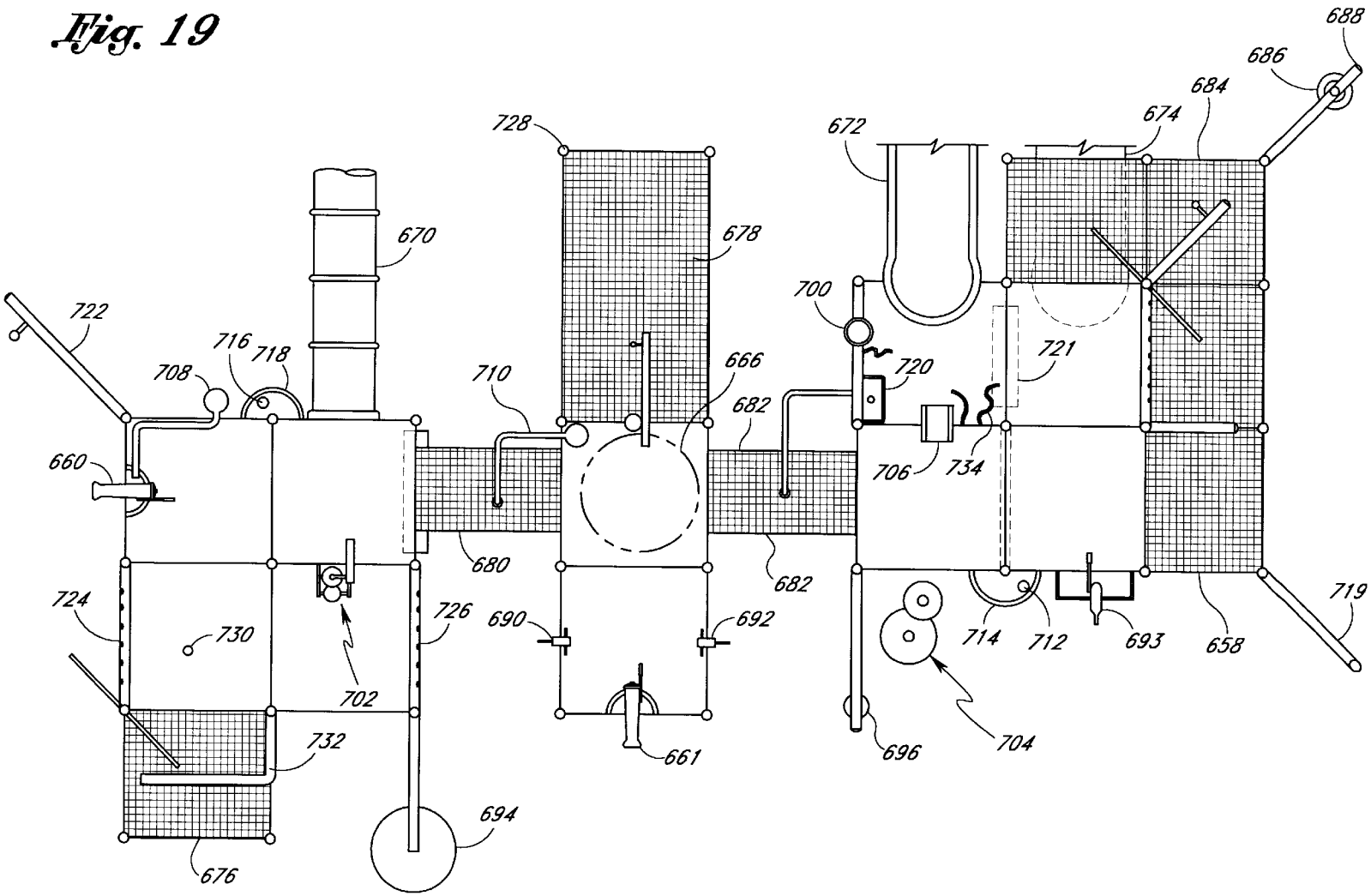
FIG. 19 is a plan view of the participatory water play system of FIG. 18.

FIG. 19 is a plan view of the participatory water play system of FIG. 18, illustrating the preferred arrangement of participatory water play elements comprising the pirate ship embodiment 650. Wet and dry slides 670, 672, 674 are provided on the back of the play structure 650, as shown. Various climbing nets 676, 678 and crawl tunnels 680, 682, 684 are also provided, for allowing play participants to safely negotiate their way through the various levels and platforms of the play structure 650. A tire swing 686 is positioned under an umbrella jet 688, as shown. The umbrella jet 688 forms an umbrella-like spray pattern which issues over users of the tire swing 686 and other participants nearby.

A plurality of participatory water play elements are also provided, including water guns 690, 692, pump guns 693, water cannons 660, 661, spinning water trays 694, spiralling spouts 696, single or tandem tipping buckets 700, 702, double funnels 704, and tipping trays 706. Funnel and pipe series 708, 710 may carry water to a water cannon 660 or may spray water over a net tunnel 680, respectively. Buckets 712, 716 dipped into basins 714, 718 may also dump water onto those below. A sink with plugged outlet 720 is another option for dousing unsuspecting, nearby participants. Other water effects may include pipe falls 719, water curtains 721, overhead sprays 722, arch jets 724, horizontal jets 726, peacock jets 728, geyser jets 730, bar jets 732, and hose jets 734, as shown. These effects are described above in connection with FIGS. 17*a–g*.

Although this invention has been disclosed in the context of certain preferred embodiments, it will be understood by those skilled in the art that the present invention extends beyond the specifically disclosed embodiments to other alternative embodiments of the invention. Thus, it is intended that the scope of the present invention herein disclosed should not be limited by the particular disclosed embodiments described above, but should be determined only by reference to the claims that follow.

It is claimed:

1. A participatory water play structure for cooling and entertaining play participants, said water play structure comprising:

a support structure;

a conduit system associated with said support structure for supplying water from a pressurized source;

a plurality of first-order participatory water play elements disposed on said support structure and comprising at least one water forming device and a corresponding control actuator for allowing play-participants to create a first water effect; and a plurality of second-order participatory water play elements disposed on said support structure, at least one of said second-order water play elements being adapted to receive water from said first water effect and to store or impart energy thereto to create a second water effect;

whereby play participants can observe and experiment with various multiple-order cause-and-effect reactions utilizing water.

2. A play structure in accordance with claim 1, wherein said support structure comprises a frame formed from a plurality of interconnected conduits forming said conduit system.

3. A play structure in accordance with claim 2, wherein said conduits comprise galvanized steel pipe having an outer diameter of between about 4 and 8 inches.

4. A play structure in accordance with claim 2, wherein said frame further comprises a plurality of non-water carrying framing elements.

5. A play structure in accordance with claim 4, wherein said framing elements comprise PVC pipes or beams.

6. A play structure in accordance with claim 1, wherein said support structure is formed substantially entirely from non-water carrying framing elements covered in a suitable surfacing material.

7. A play structure in accordance with claim 6, wherein said surfacing material comprises fiberglass or gunite.

8. A play structure in accordance with claim 5, wherein said surfacing material comprises cement or stucco.

9. A play structure in accordance with claim 6, wherein said conduit system comprises conduits or tubing disposed within said support structure.

10. A play structure in accordance with claim 1 wherein said support structure is formed in the shape of a play object such as an animal, dwelling or vehicle.

11. A play structure in accordance with claim 10 wherein said support structure is formed in the shape of an island wilderness treehouse.

12. A play structure in accordance with claim 10 wherein said support structure is formed in the shape of a pirate ship or pirate's village.

13. A play structure in accordance with claim 1, wherein at least one of said first-order participatory water play elements comprises a water spigot and an associated control valve actuator for allowing play participants to fill a basin or other water receptacle.

14. A play structure in accordance with claim 1, wherein at least one of said first-order participatory water play elements comprises a spray hose and an associated control valve actuator.

15. A play structure in accordance with claim 1, wherein at least one of said first-order participatory water play elements comprises a spiraling water spout and an associated control valve actuator.

16. A play structure in accordance with claim 1, wherein at least one of said first-order participatory water play elements comprises a conduit having a plurality of longitudinally spaced openings formed in the outer wall thereof and an associated control valve actuator for allowing play participants to selectively spray streams of jetted water.

17. A play structure in accordance with claim 16 wherein said longitudinally spaced openings comprise recessed nipple nozzles.

18. A play structure in accordance with claim 1, wherein at least one of said second-order participatory water play elements comprises a giant spilling bucket adapted to be filled or emptied by play participants via one or more associated control actuators.

19. A play structure in accordance with claim 1, wherein at least one of said second-order participatory water play elements comprises a pump operated geyser adapted to pump water from an associated water basin.

20. A play structure in accordance with claim 1, wherein at least one of said second-order participatory water play elements comprises a pump operated water gun adapted to pump water from an associated water basin.

21. A play structure in accordance with claim 1, wherein at least one of said second-order participatory water play elements comprises a spinning water tray adapted to be operated via a hand-crank actuator.

22. A play structure in accordance with claim 1, wherein at least one of said second-order participatory water play elements comprises a plurality of interconnected tipping trays and rotatable troughs adapted to selectively channel a flow of water from a first water effect to produce a second delayed water effect.

23. A play structure in accordance with claim 1, wherein at least one of said second-order participatory water play elements comprises a crank-operated bucket conveyer adapted to lift water from an associated water basin.

24. A play structure in accordance with claim 1, wherein at least one of said second-order participatory water play elements comprises a crank-operated water screw adapted to lift water from an associated water basin.

25. A play structure in accordance with claim 1, wherein at least one of said second-order participatory water play elements comprises a spinning water wheel adapted to produce a second water effect when impinged upon by a stream of water from a first water effect.

26. A play structure in accordance with claim 1, further comprising a third-order participatory water play element adapted to receive water from a second water effect to create a third water effect.

27. A play structure in accordance with claim 26, further comprising higher-order participatory water play elements.

28. A play structure in accordance with claim 1, further comprising one or more non-water play elements for entertaining play participants.

29. A play structure in accordance with claim 1, further comprising a water slide which play participants may enter from said support structure.

30. A play structure in accordance with claim 1, further comprising a plurality of decorative panels for providing shelter and/or simulating a desired play theme.

31. A play structure in accordance with claim 1, further comprising a recirculation pump for delivering water under pressure to said first-order participatory water play elements.

32. A play structure in accordance with claim 31, wherein said recirculation pump comprises an end-suction vertical turbine type pump having a capacity of between about 1000 and 3000 gpm and a maximum head of between about 30 and 60 feet of water.

33. A play structure in accordance with claim 31, further comprising a control valve manifold for regulating a balanced flow of water to said plurality of first-order participatory water play elements.

34. A play structure in accordance with claim 33, wherein said control valve manifold comprises a manifold housing having at least one inlet for receiving water from said recirculation pump and a plurality of outlets each having a corresponding control valve for delivering a substantially balanced flow of water to said plurality of first-order participatory water play elements.

35. A participatory water play apparatus for allowing play participants to observe and experiment with various cause-and-effect reactions involving water, said water play apparatus comprising:

a first-order participatory water play element connected to a source of water under pressure adapted to be controlled by one or more play participants to create a first water effect; and a second-order participatory water play element disposed proximate said first participatory water play element for receiving water from said first water effect and storing or imparting energy thereto to create a second water effect.

36. A participatory water play apparatus for allowing play participants to observe and experiment with various multiple-order cause-and-effect reactions involving water, said water play apparatus comprising a plurality of tipping trays at least one of which is tilted such that water will flow from one end to the other and adapted to be positioned by one or more play participants to selectively channel a flow of water in either one of two directions depending upon the position of said tipping tray from a first elevation to a second elevation lower that said first elevation.

37. A participatory water play apparatus in accordance with claim 36 wherein at least one of said tipping trays comprises a swivel base such that said tipping tray is adapted to tip as well as rotate about said swivel base.

38. A delayed reaction water effect for cooling and entertaining play participants, said water effect comprising:

a large water container adapted to receive and accumulate substantial quantities of water, said water container being bistably pivotably mounted such that when said water container accumulates more than a predetermined quantity of water it spills over cooling and entertaining play participants; and means for filling said water container with water.

39. A delayed reaction water effect in accordance with claim 38 wherein said water container has a capacity of between about 100 and 3000 gallons of water.

40. A delayed reaction water effect in accordance with claim 38 wherein said water container has a capacity of about 1000 gallons of water.

41. A delayed reaction water effect in accordance with claim 38 wherein said water container is provided in the shape of a giant bucket.

42. A delayed reaction water effect in accordance with claim 38 wherein said water container is provided in the shape of a giant skull.

43. A delayed reaction water effect in accordance with claim 38 wherein said means for filling said water container comprises an adjacent open pipe or other water forming element for providing a substantially continuous flow of water into said water container.

44. A delayed reaction water effect in accordance with claim 38 wherein said means for filling said water container comprises an adjacent open pipe or other water forming element for providing a substantially intermittent flow of water into said water container.

45. A delayed reaction water effect in accordance with claim 38 wherein said means for filling said water container comprises an adjacent participatory water play element for allowing play participants to selectively fill said water container.

46. A delayed reaction water effect in accordance with claim 45 further comprising an adjacent participatory water play element for allowing play participants to draw water from said water container so as to prevent it from spilling.

47. A delayed reaction water effect in accordance with claim 38 further comprising means for indicating the level of water in said water container.

48. A delayed reaction water effect for cooling and entertaining play participants, said water effect comprising:

a large water container adapted to receive and accumulate substantial quantities of water, said water container being bi-stably pivotably mounted such that when said water container accumulates more than a predetermined quantity of water it spills over cooling and entertaining play participants; and a water forming element mounted adjacent to said water container for delivering a flow of water to said water container so as to cause said water container to periodically spill over.

* * * * *

UNITED STATES PATENT AND TRADEMARK OFFICE

CERTIFICATE OF CORRECTION

PATENT NO. : 5,820,471
APPLICATION NO. : 08/409133
DATED : October 13, 1998
INVENTOR(S) : Rick A. Briggs It is certified that error appears in the above-identified patent and that said Letters Patent is hereby corrected as shown below:

| COLUMN | LINE | ERROR |
|---|---|---|
| 18 (Claim 38, | line 3) | "A large water container adapted" should read --a large water container pivotably mounted on a support structure and being adapted-- |
| 18 (Claim 48, | line 3) | "A large water container adapted" should read --a large water container pivotably mounted on a support structure and being adapted-- |

Signed and Sealed this

Nineteenth Day of January, 2010

David J. Kappos

David J. Kappos
*Director of the United States Patent and Trademark Office*